US009463626B2

(12) United States Patent
Tsuzawa

(10) Patent No.: US 9,463,626 B2
(45) Date of Patent: Oct. 11, 2016

(54) LIQUID DROPLET DISCHARGE DEVICE

(71) Applicant: FUJIFILM Corporation, Tokyo (JP)
(72) Inventor: Yoshiyuki Tsuzawa, Kanagawa (JP)
(73) Assignee: FUJIFILM Corporation, Tokyo (JP)

( * ) Notice: Subject to any disclaimer, the term of this patent is extended or adjusted under 35 U.S.C. 154(b) by 0 days.
(21) Appl. No.: 15/081,239
(22) Filed: Mar. 25, 2016
(65) Prior Publication Data
US 2016/0207315 A1 Jul. 21, 2016

Related U.S. Application Data
(63) Continuation of application No. PCT/JP2014/075183, filed on Sep. 24, 2014.
(30) Foreign Application Priority Data
Sep. 27, 2013 (JP) ..... 2013-201868
(51) Int. Cl.
*B41J 2/165* (2006.01)
(52) U.S. Cl.
CPC ..... *B41J 2/16505* (2013.01); *B41J 2/16508* (2013.01); *B41J 2/16535* (2013.01); *B41J 2/16588* (2013.01); *B41J 2002/1655* (2013.01)
(58) Field of Classification Search
CPC .. B41J 2/165; B41J 2/16505; B41J 2/16511; B41J 2/16523; B41J 2/16547; B41J 2/1753; B41J 2/17536; B41J 2/1754
See application file for complete search history.

(56) References Cited

U.S. PATENT DOCUMENTS 5,648,802 A * 7/1997 Abe ..... B41J 2/16505 347/29
2003/0058301 A1 3/2003 Sekiya
2004/0001117 A1* 1/2004 Choy ..... B41J 2/16505 347/29
2014/0300664 A1* 10/2014 Ulacia ..... B41J 2/16511 347/29

FOREIGN PATENT DOCUMENTS

JP H05-077432 A 3/1993
JP 2003-175617 A 6/2003
JP 2003-231267 A 8/2003
JP 2010-111046 A 5/2010
JP 2011-056792 A 3/2011

OTHER PUBLICATIONS

International Search Report—PCT/JP2014/075183 dated Jan. 6, 2015.
Written Opinion—PCT/JP2014/075183 dated Jan. 6, 2015.
International Preliminary Report on Patentability issued in Application No. PCT/JP2014/075183, dated Jun. 1, 2015.

* cited by examiner

*Primary Examiner* — Kristal Feggins
(74) *Attorney, Agent, or Firm* — Studebaker & Brackett PC

(57) ABSTRACT

There is provided a liquid droplet discharge device that allows a cap to be easily mounted on a liquid droplet discharge head while ensuring sealability. A cap 200 includes a cap body 202 that is formed of a box and a sealing member 220 that is formed of a frame. The sealing member 220 is adapted to be capable of being divided into a first frame component 222 and a second frame component 224. The first frame component 222 is provided integrally with the cap body 202 and a head 72 is provided with the second frame component 224. When the head 72 is mounted on the cap 200, the first frame component 222 and the second frame component 224 are combined with each other, surround the outer periphery of the tip portion of the head 72, and seal a gap between the head 72 and the cap 200.

12 Claims, 16 Drawing Sheets

LIQUID DROPLET DISCHARGE DEVICE

CROSS-REFERENCE TO RELATED APPLICATIONS

The present application is a Continuation of PCT International Application No. PCT/JP2014/075183 filed on Sep. 24, 2014 claiming priority under 35 U.S.C §119(a) to Japanese Patent Application No. 2013-201868 filed on Sep. 27, 2013. Each of the above applications is hereby expressly incorporated by reference, in their entirety, into the present application.

BACKGROUND OF THE INVENTION

1. Field of the Invention

The present invention relates to a liquid droplet discharge device, and more particularly, to a liquid droplet discharge device that includes a cap to be mounted on a liquid droplet discharge head.

2. Description of the Related Art

When a state in which a liquid droplet discharge head of a liquid droplet discharge device is not in use continues for a long time, non-discharge (clogging) or a defect in a discharge direction (discharge bend) is generated due to the dryness of solvent from nozzles. For this reason, a nozzle face (the surface where nozzles are disposed) of the liquid droplet discharge head is covered with a cap in a case in which the liquid droplet discharge head is not in use for a predetermined time or more.

Generally, the cap is formed of a box including an opening portion, and the cap is mounted on the liquid droplet discharge head so as to seal up the nozzle face when a tip of the liquid droplet discharge head is fitted to the opening portion (for example, JP2010-111046A, JP1993-077432A (JP-H05-077432A, and the like). Alternatively a tip of the opening portion comes into contact with a nozzle face, so that a cap is mounted on a liquid droplet discharge head so as to seal up a nozzle face (for example, JP2011-056792A or the like).

SUMMARY OF THE INVENTION

However, a cap, which is mounted on a liquid droplet discharge head so that a tip of the liquid droplet discharge head is fitted to an opening portion of the cap, has a defect in that it is difficult for the cap to be positioned when the cap is mounted.

Meanwhile, a cap, which is mounted on a liquid droplet discharge head so that an end of an opening portion of the cap comes into contact with a nozzle face, has a detect in that dirt adheres to the nozzle face when dirt adheres to a portion of the cap coming into contact with the nozzle face.

The invention has been made in consideration of the above-mentioned circumstances, and an object of the invention is to provide a liquid droplet discharge device that allows a cap to be easily mounted on a liquid droplet discharge head while ensuring sealability.

Means for achieving the above-mentioned object is as follows.

According to a first aspect, there is provided a liquid droplet discharge device including: a liquid droplet discharge head that includes a nozzle face at a tip thereof and discharges liquid droplets from nozzles provided on the nozzle face; a cap that covers the nozzle face of the liquid droplet discharge head; and a moving device configured to relatively move the liquid droplet discharge head and the cap to mount the cap on the liquid droplet discharge head. The cap includes a cap body that is formed of a box including an opening portion and is disposed so that the opening portion faces the nozzle face, and a sealing member that is formed of a frame capable of being divided into a first frame component and a second frame component, is disposed along a peripheral edge of the opening portion of the cap body, and surrounds an outer periphery of a tip portion of the liquid droplet discharge head. The cap body is provided with the first frame component, the liquid droplet discharge head is provided with the second frame component, and the cap and the liquid droplet discharge head are integrated with each other and form a frame when the cap is mounted on the liquid droplet discharge head.

According to this aspect, the cap includes the cap body formed of a box and the sealing member formed of a frame. When the cap is mounted on the liquid droplet discharge head, the liquid droplet discharge head is disposed so that the nozzle face (the face where nozzles for discharging liquid droplets are provided) faces the opening portion of the cap body. Further, the outer periphery of the tip portion of the liquid droplet discharge head is surrounded by the sealing member. Since the outer periphery of the tip portion of the liquid droplet discharge head is surrounded by the sealing member, the liquid droplet discharge head is adapted to have a structure in which external air does not easily enter a gap between the cap body and the nozzle face. Accordingly, sealability can be ensured. The sealing member formed of the frame is adapted to be capable of being divided into the first frame component and the second frame component. Accordingly, when the liquid droplet discharge head is mounted on the cap, the liquid droplet discharge head and the cap are integrated with each other and the outer periphery of the tip portion of the liquid droplet discharge head is surrounded. Therefore, since it is possible to relax positioning accuracy that is required to mount the cap, it is possible to easily mount the cap on the liquid droplet discharge head.

According to a second aspect, in the liquid droplet discharge device of the first aspect, the sealing member includes an elastic member that is provided on an inner peripheral portion of the first frame component.

According to this aspect, the elastic member is provided on an inner peripheral portion of the first frame component of the cap body. When the cap is mounted on the liquid droplet discharge head, the elastic member comes into close contact with the outer peripheral surface of the tip portion of the liquid droplet discharge head. Accordingly, sealability is further improved.

According to a third aspect, in the liquid droplet discharge device of the first or second aspect, the cap body of the cap is fixed at a predetermined position and the moving device is configured to move the liquid droplet discharge head to mount the cap on the liquid droplet discharge head.

According to this aspect, the liquid droplet discharge head is moved to a position where the cap body is installed and the cap is mounted on the liquid droplet discharge head. Since the cap body is installed so as to be fixed, the structure of the cap can be simplified.

According to a fourth aspect, in the liquid droplet discharge device of any one of the first to third aspects, joint portions of the first and second frame components have a tapered shape and are joined to each other with a constant gap therebetween.

According to this aspect, the joint portions of the first and second frame components have a tapered shape and are joined to each other with a constant gap therebetween. Accordingly, it is possible to more easily mount the cap while ensuring sealability. That is, since the joint portions of the first and second frame components are joined to each other with a constant gap therebetween, it is possible to prevent a shock that is caused by collision occurring when the cap is mounted on the liquid droplet discharge head. Further, it is possible to ensure constant clearance in the mounting of the cap and to relax positioning accuracy that is required to mount the cap. On the other hand, since a gap is formed between the joint portions, sealability deteriorates. However, since the joint portions have a tapered shape, external air does not easily enter the gap. Accordingly, constant sealability can be ensured.

According to a fifth aspect, in the liquid droplet discharge device of any one of the first to third aspects, joint portions of the first and second frame components have a labyrinth structure and are joined to each other with a constant gap therebetween.

According to this aspect, joint portions of the first and second frame components of the sealing member have a labyrinth structure and are joined to each other with a constant gap therebetween. Accordingly, it is possible to more easily mount the cap while ensuring sealability. That is, since the joint portions of the first and second frame components are joined to each other with a constant gap therebetween, it is possible to prevent a shock that is caused by collision occurring when the cap is mounted on the liquid droplet discharge head. Further, it is possible to ensure constant clearance in the mounting of the cap and to relax positioning accuracy that is required to mount the cap. On the other hand, since a gap is formed between the joint portions, sealability deteriorates. However, since the joint portions have a labyrinth structure, external air does not easily enter the gap. Accordingly, constant sealability can be ensured.

According to a sixth aspect, in the liquid droplet discharge device of any one of the first to fifth aspects, the moving device is adapted to be capable of moving the liquid droplet discharge head in a first direction along the nozzle face and a second direction orthogonal to the nozzle face, the liquid droplet discharge device further includes a controller that controls the moving device, and the controller moves the liquid droplet discharge head to a mounting position in the first direction and then moves the liquid droplet discharge head toward the cap body in the second direction to mount the cap on the liquid droplet discharge head in a case in which the cap is to be mounted on the liquid droplet discharge head and moves the liquid droplet discharge head to a separation position in the second direction and then moves the liquid droplet discharge head in the first direction to separate the cap from the liquid droplet discharge head in a case in which the cap is to be separated from the liquid droplet discharge head.

According to this aspect, the liquid droplet discharge head is provided so as to be capable of being moved in the first direction along the nozzle face and the second direction orthogonal to the nozzle face by the moving device. The movement of the liquid droplet discharge head is controlled by the controller. The controller moves the liquid droplet discharge head to a mounting position in the first direction and then moves the liquid droplet discharge head toward the cap body in the second direction to mount the cap on the liquid droplet discharge head. Further, the controller moves the liquid droplet discharge head to a separation position in the second direction and then moves the liquid droplet discharge head in the first direction to separate the cap from the liquid droplet discharge head. Accordingly, it is possible to mount/detach the cap on/from the liquid droplet discharge head by movement in two directions.

According to a seventh aspect, in the liquid droplet discharge device of the sixth aspect, the outer periphery of the tip portion of the liquid droplet discharge head has a quadrangular shape; and the sealing member is formed of a quadrangular frame and is adapted to be capable of being divided into the first frame component, which forms three sides of the frame including two sides parallel to the first direction, and the second frame component that forms the other side of the frame.

According to this aspect, the outer periphery of the tip portion (a portion surrounded by the sealing member) of the liquid droplet discharge head is formed in a quadrangular shape. Further, the sealing member is formed of a quadrangular frame so as to correspond to the outer periphery of the end portion of the liquid droplet discharge head. Furthermore, the sealing member is adapted to be capable of being divided into the first frame component, which forms three sides of the frame including two sides parallel to the first direction, and the second frame component that forms the other side of the frame. Accordingly, since a structure provided on the liquid droplet discharge head can be simplified, it is possible to prevent the second frame component from interfering with other members during the movement of the liquid droplet discharge head or the discharge of liquid droplets.

According to an eighth aspect, in the liquid droplet discharge device of the seventh aspect, the first frame component has a height that allows the first frame component to surround the outer periphery of the tip portion of the liquid droplet discharge head when the liquid droplet discharge head is positioned at the separation position.

According to this aspect, the first frame component is adapted to be capable of surrounding the outer periphery of the tip portion of the liquid droplet discharge head even when the liquid droplet discharge head is moved to the separation position. Accordingly, it is possible to prevent the surrounding environment from being contaminated by liquid dripping from the liquid droplet discharge head when the liquid droplet discharge head is lifted from the cap.

According to a ninth aspect, the liquid droplet discharge device of the eighth aspect further includes a wiping member that is installed on a movement path of the liquid droplet discharge head moved in the first direction and comes into contact with the nozzle face of the liquid droplet discharge head moved from the separation position in the first direction to wipe the nozzle face.

According to this aspect, the liquid droplet discharge device further includes a wiping member that wipes the nozzle face of the liquid droplet discharge head. The wiping member is disposed so as to come into contact with the nozzle face of the liquid droplet discharge head that is moved from the separation position in the first direction. Accordingly, it is possible to move the liquid droplet discharge head in the first direction while the outer periphery of the tip portion of the liquid droplet discharge head is surrounded by the first frame component, and to wipe the nozzle face. Accordingly, it is possible to prevent the surrounding environment from being contaminated when the liquid droplet discharge head is detached from the cap.

According to a tenth aspect, in the liquid droplet discharge device of any one of the sixth to ninth aspects, the liquid droplet discharge head is installed to be rotated about an axis parallel to the first direction so that the nozzle face is inclined with respect to a horizontal plane.

According to this aspect, the nozzle face of the liquid droplet discharge head is disposed so as to be inclined with respect to the horizontal plane. Liquid, which is discharged from nozzles when purging is performed, flows down along the nozzle face in the case of the liquid droplet discharge head that is installed so that the nozzle face is inclined with respect to the horizontal plane. However, since the outer periphery of the tip portion of the liquid droplet discharge head is surrounded and sealed up by the sealing member, it is possible to recover liquid, which flows down from the nozzle face, without the contamination of the surrounding environment.

According to an eleventh aspect, in the liquid droplet discharge device of the tenth aspect, the liquid droplet discharge head is formed of a long line head in which nozzles are arranged along the first direction.

According to this aspect, the liquid droplet discharge head is formed of a long line head in which nozzles are arranged along the first direction. Accordingly, the second frame component can be disposed at an end portion of the liquid droplet discharge head in a longitudinal direction.

According to a twelfth aspect, in the liquid droplet discharge device of any one of the first to eleventh aspects, the cap body includes a liquid retaining part in which moisturizing liquid is stored.

According to this aspect, the liquid retaining part is provided in the cap body. Accordingly, since it is possible to maintain constant humidity in the cap body, it is possible to further improve moisture retaining properties.

According to the invention, it is possible to easily mount a cap on a liquid droplet discharge head while ensuring sealability, and to prevent contamination that is caused by the use of the cap.

DESCRIPTION OF THE PREFERRED EMBODIMENTS

An embodiment of the invention will be described in detail below with reference to the accompanying drawings.

Here, an ink jet recording device will be described as an example of a liquid droplet discharge device.

<<Ink Jet Recording Device>>

[Entire Structure]

First, the entire structure of the ink jet recording device will be generally described.

Figure 1:
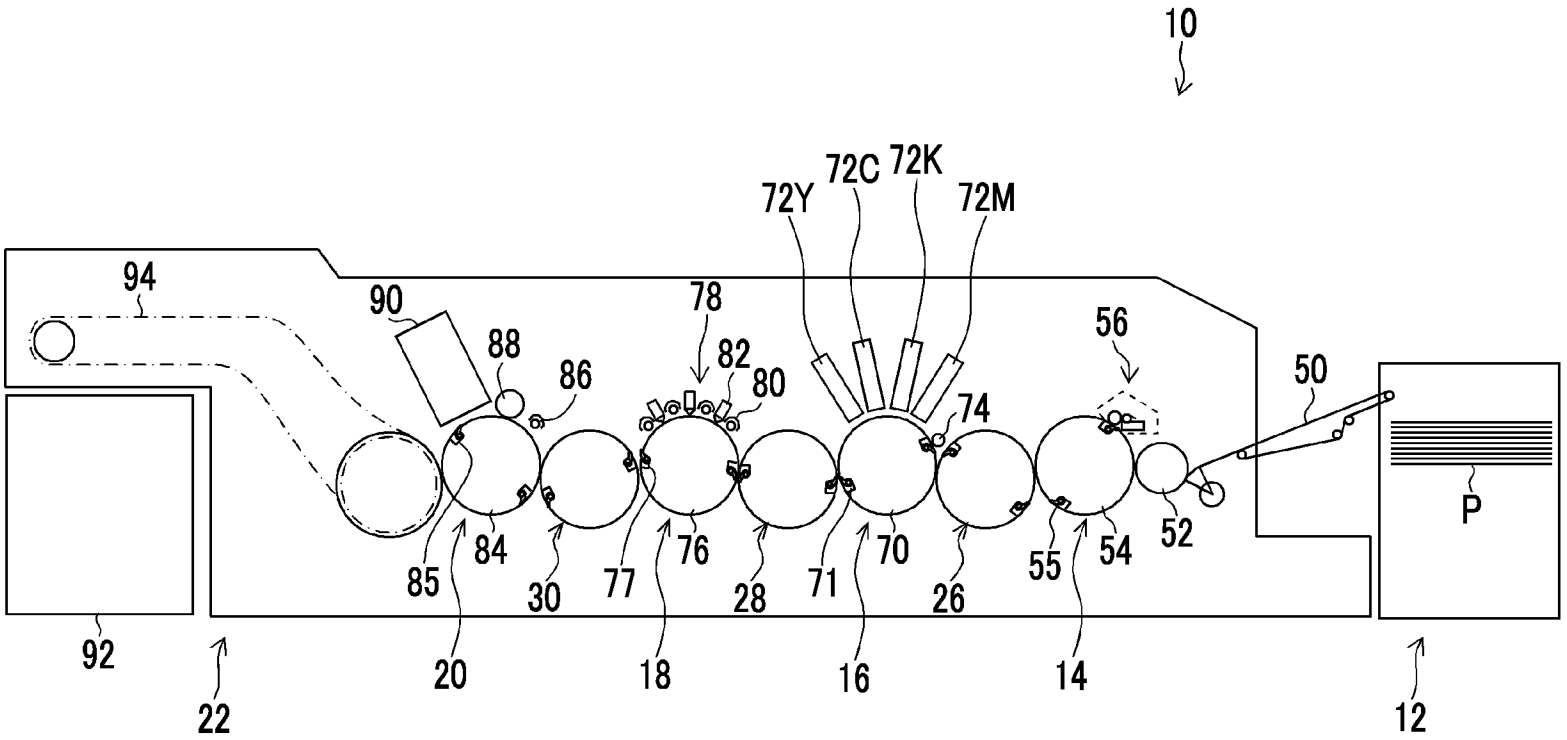
FIG. 1 is a schematic view showing the entire structure of an ink jet recording device.

FIG. 1 is a schematic view showing the entire structure of the ink jet recording device.

The ink jet recording device 10 shown in FIG. 1 is a color ink jet recording device that ejects ink droplets having four colors, that is, magenta (M), black (K), cyan (C), and yellow (Y) to a sheet (sheet of paper) P to draw a color image. The ink jet recording device 10 mainly includes a sheet feed section 12, a treatment liquid applying section 14, a drawing section 16, a drying section 18, a fixing section 20, a sheet discharge section 22, and a maintenance section (not shown).

<Sheet Feed Section>

The sheet feed section 12 performs sheet feed processing.

The sheet feed section 12 mainly includes a sheet feed tray 50 and a sheet feed device (not shown).

The sheet feed tray 50 is means for receiving sheets P, and receives (stacks) sheets P in a state in which the sheets P are stacked (the sheets form a sheet bundle).

The sheet feed device (not shown) feeds the sheets P, which are set on the sheet feed tray 50, to the treatment liquid applying section 14 from the top one by one.

<Treatment Liquid Applying Section>

The treatment liquid applying section 14 applies predetermined treatment liquid to the recording surface of the sheet P as preprocessing before the ejection of ink droplets. The treatment liquid is treatment liquid having a function to allow coloring materials of ink to aggregate. When the treatment liquid is applied to the sheet P in advance, the separation between the coloring materials of ink and solvent can be facilitated during the ejection of ink droplets. Accordingly, the occurrence of bleeding or the like can be suppressed.

The treatment liquid applying section 14 mainly includes a sheet feed cylinder 52, a treatment liquid drum 54, and a treatment liquid applying device 56.

The sheet feed cylinder 52 is means for transporting the sheet P, and receives the sheet P fed from the sheet feed section 12 and delivers the sheet P to the treatment liquid drum 54.

The treatment liquid drum 54 is means for transporting the sheet P, and transports the sheet P by rotating while winding the sheet P on the peripheral surface thereof. The treatment liquid drum 54 is provided with grippers 55. The treatment liquid drum 54 winds the sheet P on the peripheral surface thereof and transports the sheet P by rotating while gripping an end of the sheet P by the gripper 55.

The treatment liquid applying device 56 is means for applying treatment liquid, and applies treatment liquid to the sheet P that is transported by the treatment liquid drum 54.

While the sheet P is transported by the treatment liquid drum 54, treatment liquid is applied to the recording surface.

The sheet P to which the treatment liquid has been applied is delivered to a drawing drum 70 of the drawing section 16 from the treatment liquid drum 54 through an intermediate transport section 26.

<Drawing Section>

The drawing section 16 ejects ink droplets to the sheet P to perform drawing processing.

The drawing section 16 mainly includes a drawing drum 70, a sheet pressing roller 74, and ink jet heads 72M, 72K, 72C, and 72Y (hereinafter, simply referred to as "heads").

The drawing drum 70 is means for transporting the sheet P, and transports the sheet P by rotating while winding the sheet P on the peripheral surface thereof. The drawing drum 70 is provided with grippers 71. The drawing drum 70 winds the sheet P on the peripheral surface thereof and transports the sheet P by rotating while gripping an end portion of the sheet P by the gripper 71. Further, the drawing drum 70 is provided with an adsorption mechanism (not shown). The drawing drum 70 transports the sheet P while holding the sheet P on the peripheral surface thereof by the adsorption of the adsorption mechanism. For example, air pressure (negative pressure) or static electricity is used for adsorption.

The sheet pressing roller 74 is means for pressing the sheet P against the drawing drum 70, and presses the surface of the sheet P, which is wound on the peripheral surface of the drawing drum 70, to make the sheet P come into close contact with the peripheral surface of the drawing drum 70.

The heads 72M, 72K, 72C, and 72Y as liquid droplet discharge heads are means for drawing an image, and discharge magenta, black, cyan, and yellow ink droplets to the sheet P, which is transported by the drawing drum 70, to draw a color image on the sheet P.

Each of the heads 72M, 72K, 72C, and 72Y is formed of a long line head having a length corresponding to the width of the sheet. The respective heads 72M, 72K, 72C, and 72Y are disposed to be orthogonal to the transport direction of the sheet P, which is transported by the drawing drum 70, and are disposed at regular intervals along the outer periphery of the drawing drum 70. For this reason, each of the heads 72M, 72K, 72C, and 72Y is disposed so that a nozzle face formed at a tip of each of the heads 72M, 72K, 72C, and 72Y is inclined with respect to a horizontal plane.

While the sheet P is transported by the drawing drum 70, magenta, black, cyan, and yellow ink droplets are ejected to the sheet P from the heads 72M, 72K, 72C, and 72Y. As a result, an image is drawn on the sheet.

For example, ink, which contains a high-boiling solvent and polymer fine particles (thermoplastic resin particles), is used as the ink.

The sheet P on which the image has been drawn is delivered to a drying drum 76 of the drying section 18 from the drawing drum 70 through an intermediate transport section 28.

<Drying Section>

The drying section 18 performs processing for drying the sheet P on which the image has been drawn. That is, the drying section 18 dries and removes a solvent component of ink from the sheet P to which ink droplets have been ejected.

The drying section 18 mainly includes a drying drum 76 and a solvent drying device 78.

The drying drum 76 is means for transporting the sheet P, and transports the sheet P by rotating while winding the sheet P on the peripheral surface thereof. The drying drum 76 is provided with grippers 77. The drying drum 76 winds the sheet P on the peripheral surface thereof and transports the sheet P by rotating while gripping an end portion of the sheet P by the gripper 77.

The solvent drying device 78 is means for drying the sheet P, and dries and removes solvent by blowing hot air to the sheet P that is transported by the drying drum 76. The solvent drying device 78 includes a plurality of heaters 80 that are disposed along a transport path for the sheet P transported by the drying drum 76, and a plurality of hot air nozzles 82 that are disposed between the heaters 80, respectively.

While the sheet P is transported by the drying drum 76, hot air is blown to the sheet P from the solvent drying device 78 and the sheet P is subjected to drying processing.

The sheet P, which has been subjected to drying processing by the drying section 18, is delivered to a fixing drum 84 of the fixing section 20 from the drying drum 76 through an intermediate transport section 30.

<Fixing Section>

The fixing section 20 performs processing for fixing the image, which is recorded on the sheet P, and checks the image.

The fixing section 20 mainly includes a fixing drum 84, a heater 86, a fixing roller 88, and an in-line sensor 90.

The fixing drum 84 is means for transporting the sheet P, and transports the sheet P by rotating while winding the sheet P on the peripheral surface thereof. The fixing drum 84 is provided with grippers 85. The fixing drum 84 winds the sheet P on the peripheral surface thereof and transports the sheet P by rotating while gripping an end portion of the sheet P by the gripper 85.

The heater 86 is means for heating the sheet P, and preliminarily heats the sheet P that is transported by the fixing drum 84.

The fixing roller 88 is means for fixing an image, and melts fine particles of a self-dispersing polymer contained in the ink and forms the ink in the shape of a film by heating and pressurizing the sheet P that is transported by the fixing drum 84.

The in-line sensor 90 is means for reading the image that is drawn on the sheet P, and is formed of, for example, a line sensor. The density of the image, a defect of the image, and the like are detected on the basis of information about the image that is read by the in-line sensor 90 (including a test chart for the measurement of density, a test pattern for the detection of non-discharge, and the like).

While the sheet P is transported by the fixing drum 84, the sheet P is preliminarily heated by the heater 86. Then, the sheet P is heated and pressurized by the fixing drum 84, so that the drawn image is fixed. Further, as necessary, the image is read by the in-line sensor 90 after fixing processing and various checks are performed on the basis of the read image.

<Sheet Discharge Section>

The sheet discharge section 22 performs processing for recovering the sheet P on which the image has been drawn.

The sheet discharge section 22 mainly includes a sheet discharge tray 92 and a chain conveyor 94.

The sheet discharge tray 92 is means for receiving sheets P. and receives (stacks) sheets P in a state in which the sheets P are stacked.

The chain conveyor 94 is means for transporting the sheet P, and receives the sheet P from the fixing drum 84, transports the sheet P to the sheet discharge tray 92, and discharges the sheet P into the sheet discharge tray.

<Maintenance Section>

The maintenance section performs the maintenance of the heads 72M, 72K, 72C, and 72Y.

The maintenance section is provided with nozzle face wiping devices that wipe the nozzle faces of the heads 72M, 72K, 72C, and 72Y and caps that cover the nozzle faces of the heads 72M, 72K, 72C, and 72Y.

When a state in which the heads 72M, 72K, 72C, and 72Y are not in use is continued for a long time, non-discharge or a defect in a discharge direction is generated due to the dryness of solvent from the nozzles. Accordingly, the nozzle faces are covered with the caps in the maintenance section in a case in which the heads are not in use for a predetermined time or more.

Further, the purging (processing for discharging ink from the nozzles by a method other than discharge) of the heads 72M, 72K, 72C, and 72Y is performed as a part of maintenance, but this purging is also performed by the maintenance section. That is, purging is performed by the discharge of ink in a state in which the nozzle faces are covered with the caps.

Furthermore, when dirt adheres to the nozzle faces of the heads 72M, 72K, 72C, and 72Y, a discharge defect such as a defect in a discharge direction is generated. For this reason, the nozzle faces are regularly wiped in the maintenance section by the nozzle face wiping devices.

The maintenance section will be described in detail below.

[Outline of Recording of Image Performed by Ink Jet Recording Device]

The sheet P, which is fed from the sheet feed section 12, is delivered to the treatment liquid drum 54 through the sheet feed cylinder 52.

While the sheet P delivered to the treatment liquid drum 54 is transported by the treatment liquid drum 54, treatment liquid is applied to the recording surface of the sheet P by the treatment liquid applying device 56. The sheet P to which treatment liquid has been applied is delivered to the drawing drum 70 of the drawing section 16 from the treatment liquid drum 54 through the intermediate transport section 26.

While the sheet P delivered to the drawing drum 70 is transported by the drawing drum 70, magenta, black, cyan, and yellow ink droplets are ejected to the recording surface of the sheet P by the heads 72M, 72K, 72C, and 72Y. As a result, an image is drawn on the recording surface. The sheet P on which the image has been drawn is delivered to the drying drum 76 of the drying section 18 from the drawing drum 70 through the intermediate transport section 28.

While the sheet delivered to the drying drum 76 is transported by the drying drum 76, hot air is blown to the sheet from the solvent drying device 78 and the sheet is subjected to drying processing. The sheet P, which has been subjected to drying processing, is delivered to the fixing drum 84 of the fixing section 20 from the drying drum 76 through the intermediate transport section 30.

While the sheet P delivered to the fixing drum 84 is transported by the fixing drum 84, the sheet P is subjected to fixing processing by the heater 86 and the fixing roller 88 (after that, as necessary, the image is read by the in-line sensor 90).

The image, which has been subjected to fixing processing, is delivered to the chain conveyor 94 of the sheet discharge section 22, is transported to the sheet discharge tray 92 by the chain conveyor 94, and is recovered by the sheet discharge tray 92.

<<Head>>

Next, the heads will be generally described.

The ink jet recording device 10 of this embodiment is provided with the four heads 72M, 72K, 72C, and 72Y. However, since the respective heads 72M, 72K, 72C, and 72Y have the same structure, the heads 72M, 72K, 72C, and 72Y will be described as the heads 72 here.

Figure 2:
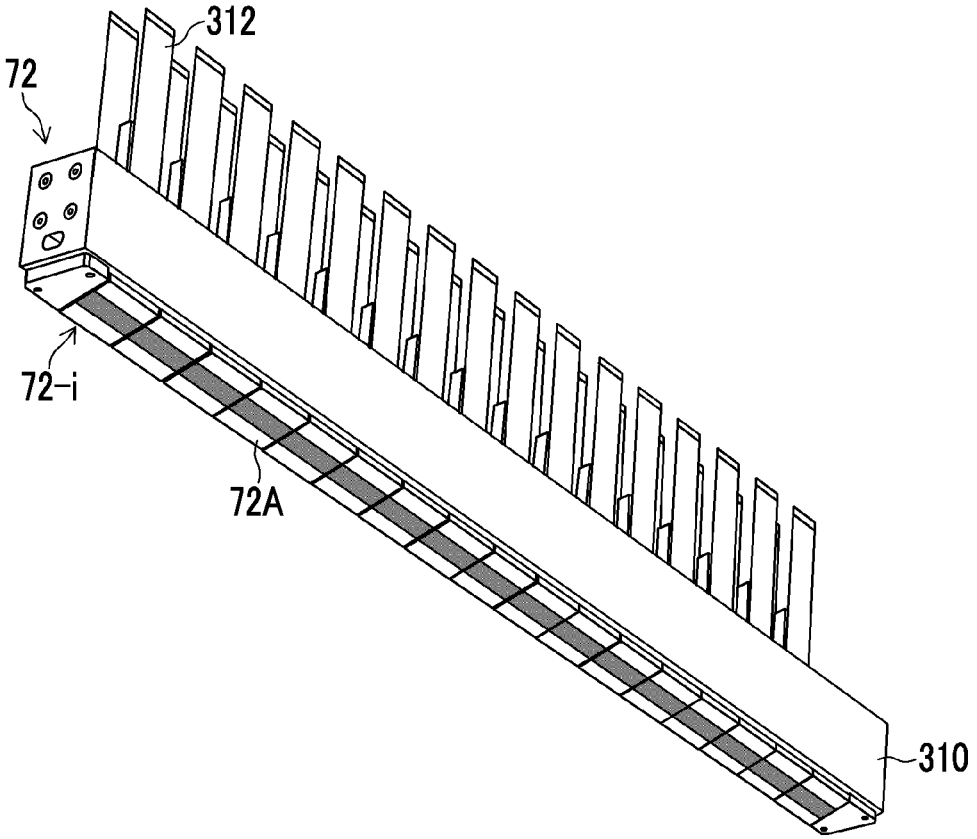
FIG. 2 is a perspective view showing the structure of a tip portion of a head.

FIG. 2 is a perspective view showing the structure of a tip portion of the head.

As described above, the head 72 of this embodiment is formed of a long line head. A tip portion of the head 72, which is a discharge portion, has a block shape (rectangular parallelopiped shape), and the head 72 includes a nozzle face 72A formed at the tip thereof. Nozzles, which discharge ink, are provided on the nozzle face 72A.

Further, the head 72 of this embodiment includes a plurality of head modules 72-*i* (i=1, 2 . . . n) that are joined in one line. The respective head modules 72-*i* are mounted on a support frame 310 and integrated so as to be joined in one line. Each of the head modules 72-*i* is detachably mounted on the support frame 310 so as to be replaceable.

Meanwhile, reference numeral 312 of FIG. 2 denotes an electrical connection cable that extends from each head module 72-*i*.

Figure 3:
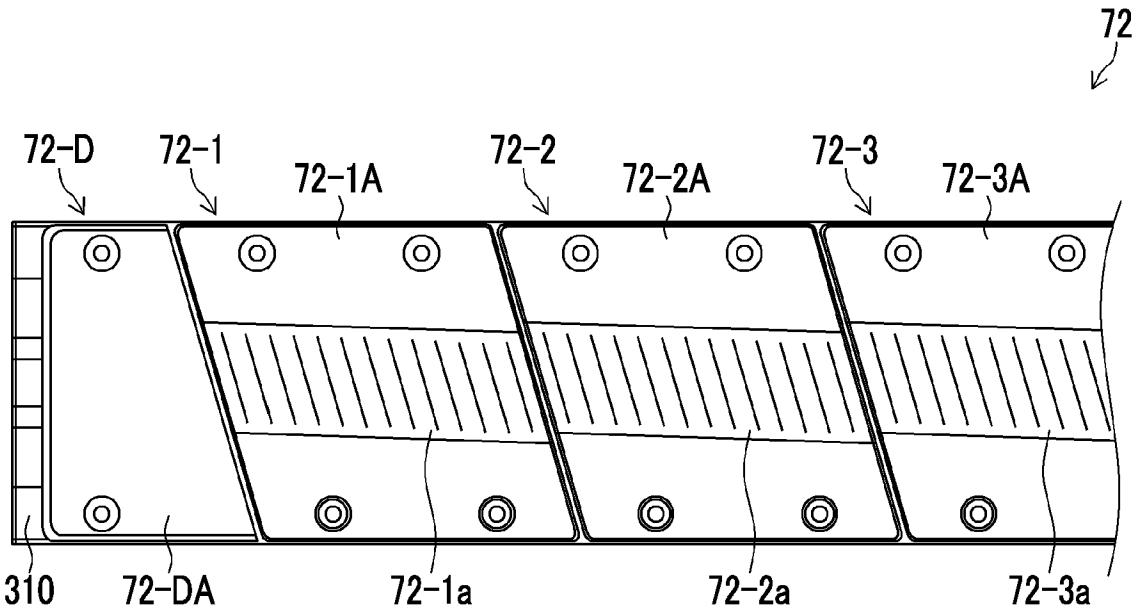
FIG. 3 is an enlarged view of a part of a nozzle face of the head.

FIG. 3 is an enlarged view of a part of the nozzle face of the head.

The nozzle face 72-iA of each head module 72-*i* is formed in the shape of a parallelogram. Since the respective head modules 72-*i* are joined, the nozzle faces 72-iA of the respective head modules 72-*i* are joined. Accordingly, one nozzle face 72A is formed as a whole.

Meanwhile, dummy plates 72-D are mounted on both ends of the support frame 310. As a result, the nozzle face 72A of the head 72 corresponds to the surfaces 72-DA of the dummy plates (corresponding to the nozzle faces), and is formed in a rectangular shape as a whole.

A belt-like nozzle arrangement portion 72-*ia* (substantive nozzle face) is provided in a middle portion of the nozzle face 72-iA of each head module 72-*i*. Nozzles 350 are provided in the nozzle arrangement portion 72-*ia*.

Figure 4:
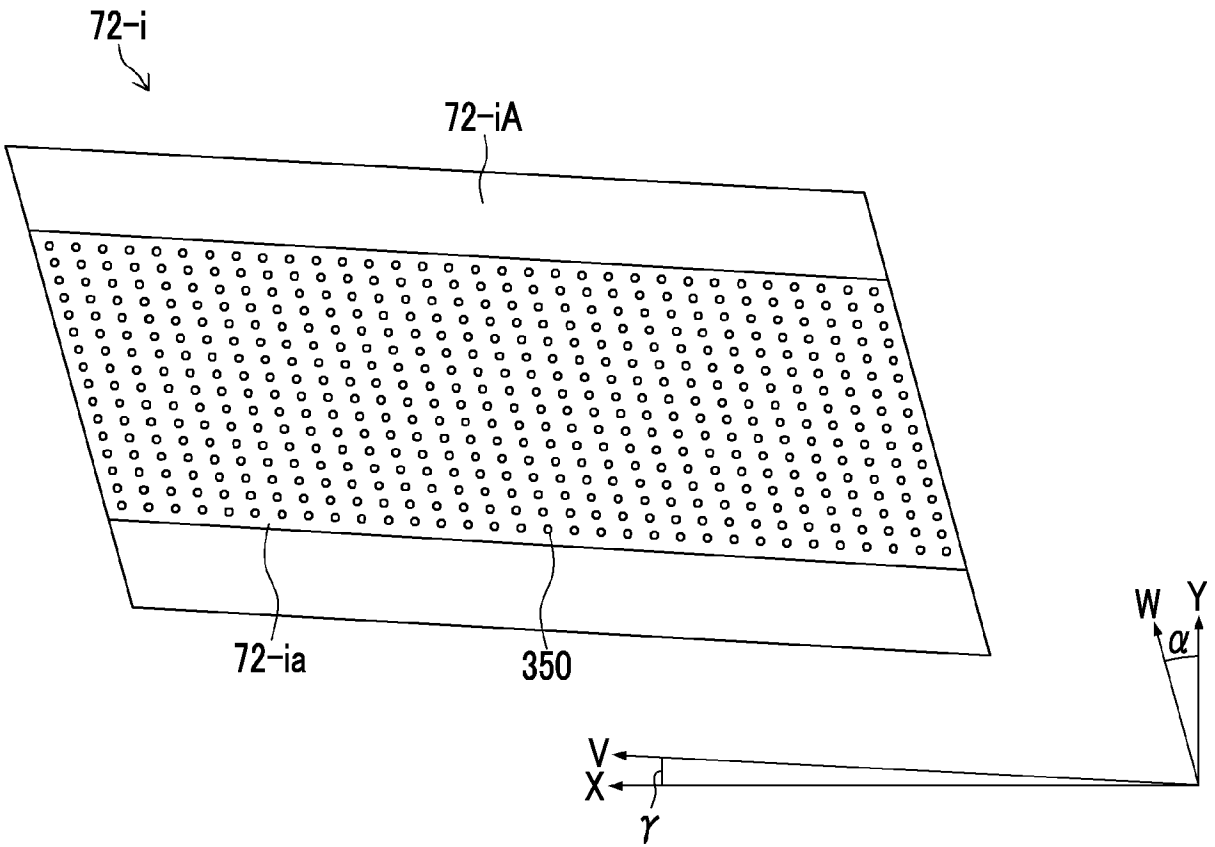
FIG. 4 is a plan view of a nozzle arrangement portion of the nozzle face of a head module.

FIG. 4 is a plan view of the nozzle arrangement portion of the nozzle face of the head module. In FIG. 4, Y denotes a transport direction (sub-scanning direction) of the sheet P and X denotes the longitudinal direction (main scanning direction) of the head 72.

In FIG. 4, the nozzles 350 are arranged in the nozzle arrangement portion 72-*ia* in the form of a matrix. In more detail, the nozzles 350 are arranged at a constant pitch along a straight line V that is inclined with respect to an X direction (row direction) by a predetermined angle ($\gamma$), and the nozzles 350 are arranged at a constant pitch along a straight line W that is inclined with respect to a Y direction by a predetermined angle ($\alpha$). Since it is possible to reduce a substantive interval between the nozzles 350 projected in the main scanning direction (X direction) by arranging the nozzles 350 in this way, it is possible to densely dispose the nozzles 350. Meanwhile, the substantive arrangement direction of the nozzles 350 in this case is the X direction (main scanning direction).

<<Maintenance Section>>

The maintenance section 24 performs the maintenance of the heads 72M, 72K, 72C, and 72Y as described above.

The maintenance section is installed adjacent to the drawing section 16. The heads 72M, 72K, 72C, and 72Y are moved to the maintenance section in a case in which the maintenance of the heads 72M, 72K, 72C, and 72Y is to be performed. For this reason, the ink jet recording device 10 is provided with a head moving mechanism 130 as a moving device.

[Head Moving Mechanism]

Figure 5:
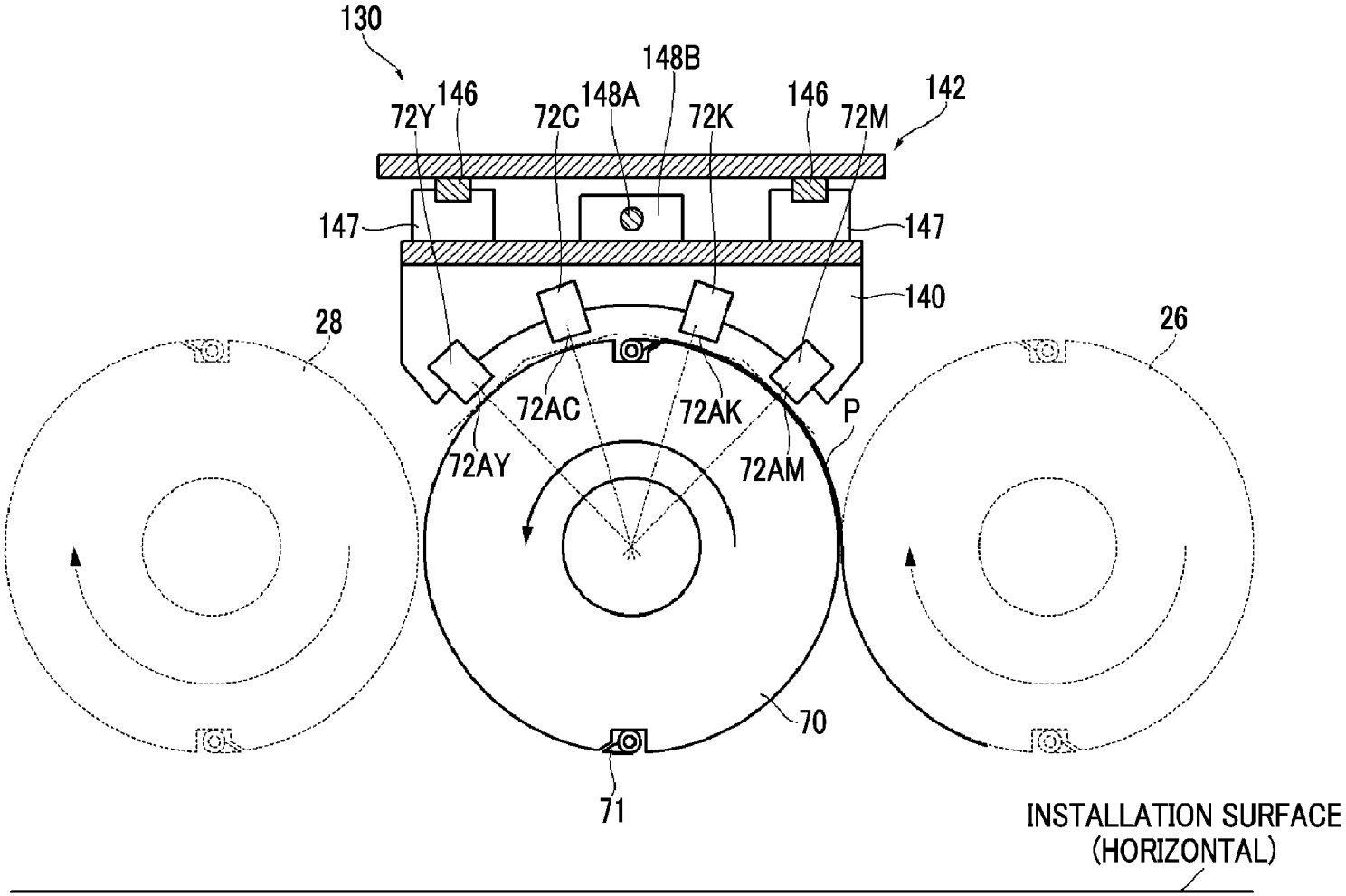
FIG. 5 is a side view showing the schematic structure of a head moving mechanism.
Figure 6:
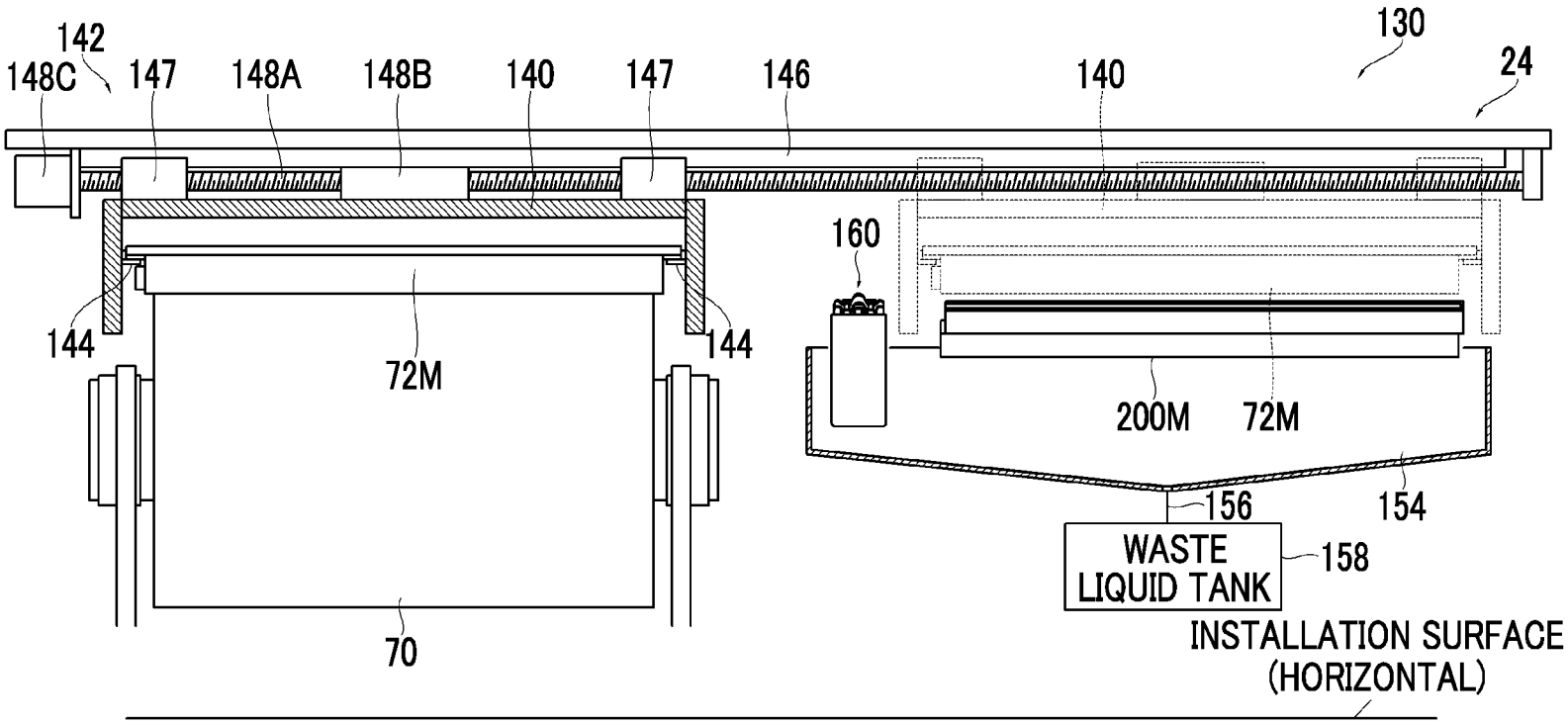
FIG. 6 is a front view showing the schematic structure of the head moving mechanism.

FIG. 5 is a side view showing the schematic structure of the head moving mechanism, and FIG. 6 is a front view showing the schematic structure of the head moving mechanism.

The head moving mechanism 130 moves the respective heads 72M, 72K, 72C, and 72Y along the nozzle faces 72AM, 72AK, 72AC, and 72AY in the longitudinal direction, and moves the respective heads 72M, 72K, 72C, and 72Y in a direction orthogonal to the nozzle faces 72AM, 72AK, 72AC, and 72AY. The head moving mechanism 130 includes a head support frame 140 that supports the heads 72M, 72K, 72C, and 72Y and a frame transfer device 142 that transfers the head support frame 140.

The head support frame 140 supports both end portions of the heads 72M, 72K, 72C, and 72Y, and supports the respective heads 72M, 72K, 72C, and 72Y in parallel to the rotation axis of the drawing drum 70.

The head support frame 140 is provided with a pair of head supports 144 that support both end portions of each of the heads 72M, 72K, 72C, and 72Y. The head supports 144 are provided for each head, and the head supports 144 are disposed at a constant interval on a concentric circle that has a center on the rotation axis of the drawing drum 70.

The respective head supports 144 are provided with head lifting means (not shown) for moving the supported heads 72M, 72K, 72C, and 72Y up and down. The head lifting means move the supported heads 72M, 72K, 72C, and 72Y up and down in the radial direction of the drawing drum 70 (the head lifting means move the supported heads 72M, 72K, 72C, and 72Y up and down in directions (second directions) orthogonal to the nozzle faces 72AM, 72AK, 72AC, and 72AY of the supported heads 72M, 72K, 72C, and 72Y).

The frame transfer device 142 transfers the head support frame 140 in the longitudinal direction of the heads 72M, 72K, 72C, and 72Y. The frame transfer device 142 includes a pair of guide rails 146 and a feed device 148.

The pair of guide rails 146 is horizontally disposed along the rotation axis of the drawing drum 70. The head support frame 140 is slidably supported by the guide rails 146 with sliders 147 interposed therebetween.

The feed device 148 includes a screw rod 148A, a nut member 148B that is threadedly engaged the screw rod 148A, and a motor 148C that rotates the screw rod 148A.

The screw rod 148A is horizontally disposed along the rotation axis of the drawing drum 70. The screw rod 148A is disposed between the pair of guide rails 146.

The nut member 148B is threadedly engaged with the screw rod 148A and is connected to the head support frame 140. Accordingly, when the screw rod 148A is rotated, the head support frame 140 is moved along the guide rails 146.

The motor 148C is driven so as to be capable of rotating the screw rod 148A in a normal direction and a reverse direction. When the motor 148C is driven in a normal direction, the head support frame 140 is moved along the guide rails 146 toward the maintenance section from the drawing section 16. Further, when the motor 148C is driven in a reverse direction, the head support frame 140 is moved along the guide rails 146 toward the drawing section 16 from the maintenance section.

The head moving mechanism 130 having the above-mentioned structure moves the respective heads 72M, 72K, 72C, and 72Y in the longitudinal direction (a first direction) by driving the motor 148C. Further, when the head lifting means (not shown) of the head supports 144 of the head support frame 140 are operated, the heads 72M, 72K, 72C, and 72Y are moved (moved up and down) in the directions (the second directions) orthogonal to the nozzle faces 72AM, 72AK, 72AC, and 72AY, respectively.

Meanwhile, the movement of the heads 72, which is performed by the head moving mechanism 130, is controlled by a controller (not shown).

[Maintenance Section]

Figure 7:
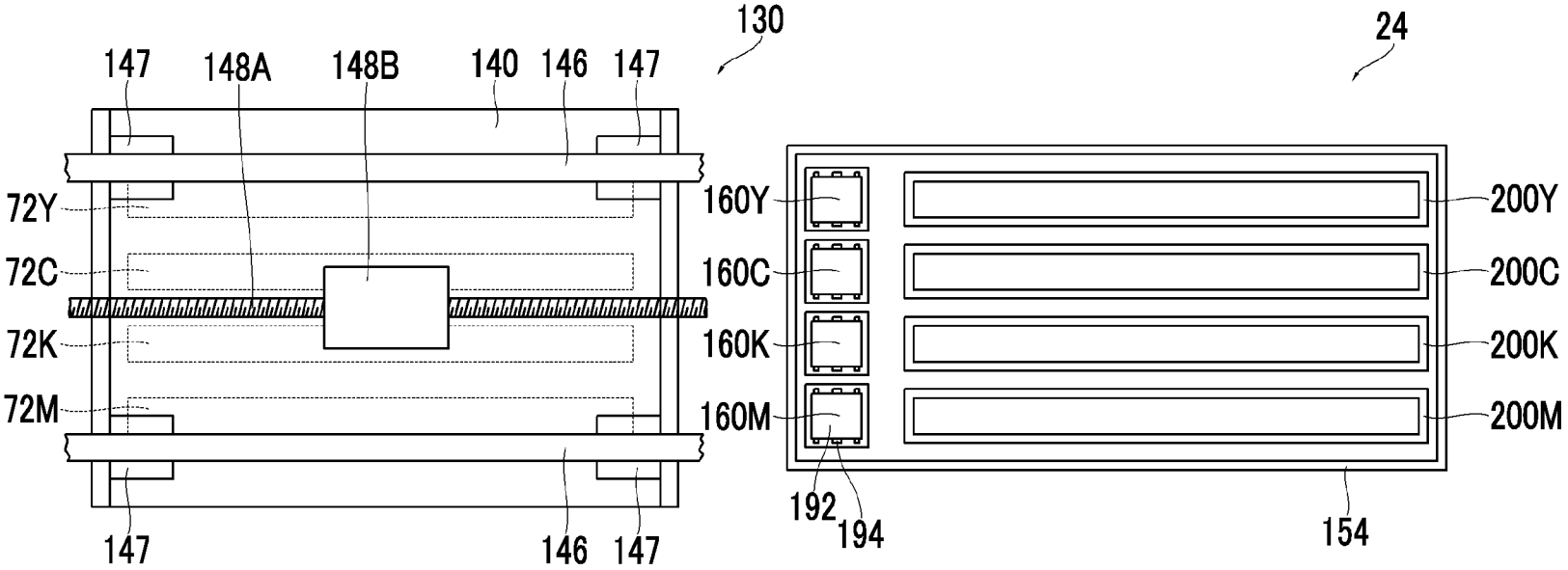
FIG. 7 is a plan view schematically showing the structure of a drawing section and the structure of a maintenance section.
Figure 8:
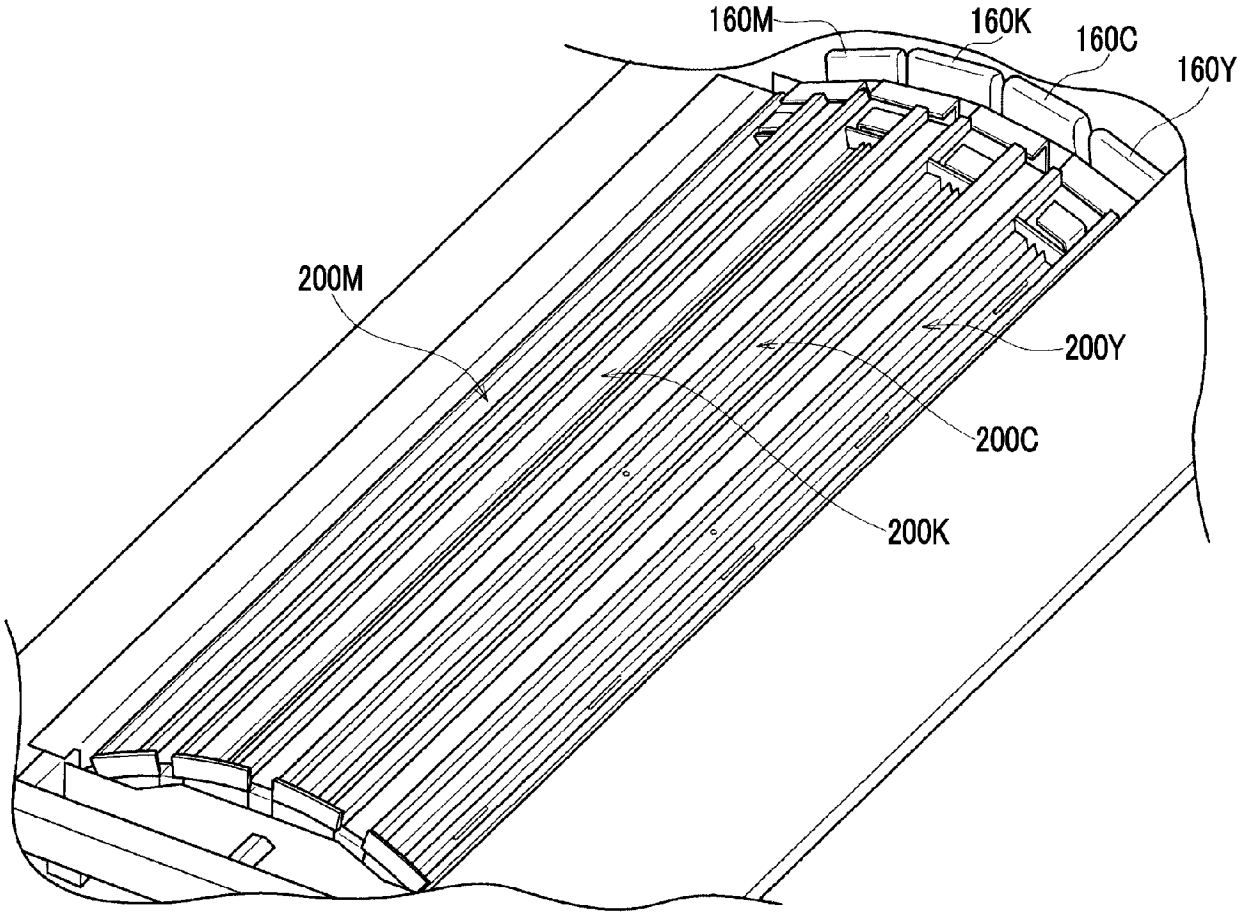
FIG. 8 is a perspective view showing the structure of the maintenance section.

FIG. 7 is a plan view schematically showing the structure of the drawing section and the structure of the maintenance section. Further, FIG. 8 is a perspective view showing the structure of the maintenance section.

The maintenance section 24 is provided with the nozzle face wiping devices 160M, 160K, 160C, and 160Y that wipe the nozzle faces of the heads 72M, 72K, 72C, and 72Y, and the caps 200M, 200K, 200C, and 200Y that cover the nozzle faces 72AM, 72AK, 72AC, and 72AY of the heads 72M, 72K, 72C, and 72Y.

<Nozzle Face Wiping Device>

The nozzle face wiping devices 160M, 160K, 160C, and 160Y individually wipe the nozzle faces 72AM, 72AK, 72AC, and 72AY of the heads 72M, 72K, 72C, and 72Y to clean the nozzle faces 72AM, 72AK, 72AC, and 72AY, respectively. The nozzle face wiping devices 160M, 160K, 160C, and 160Y are provided for the heads 72M, 72K, 72C, and 72Y, respectively.

The nozzle face wiping devices 160M, 160K, 160C, and 160Y are installed on the movement paths of the heads 72M, 72K, 72C, and 72Y that are moved along the longitudinal direction. The nozzle face wiping devices 160M, 160K, 160C, and 160Y allow wiping members to come into contact with the nozzle faces 72AM, 72AC, and 72AY of the heads 72M, 72K, 72C, and 72Y, which are moved between the drawing section 16 and the maintenance section 24, to wipe the nozzle faces 72AM, 72AK, 72AC, and 72AY.

The nozzle face wiping devices 160M, 160K, 160C, and 160Y of this embodiment allow wiping webs 192 (wiping members) to come into contact with the nozzle faces 72AM, 72AK, 72AC, and 72AY to wipe the nozzle faces 72AM, 72AK, 72AC, and 72AY, respectively.

While the wiping webs 192 are fed at a constant speed by feed devices (not shown), the wiping webs 192 are allowed to come into pressure contact with the nozzle faces 72AM, 72AK, 72AC, and 72AY by pressing rollers 194 (the wiping webs 192, which are wound from one reel (feed reel) on the other reel (take-up reel) and travel at a constant speed, are allowed to come into pressure contact with the nozzle faces 72AM, 72AK, 72AC, and 72AY by the pressing rollers 194 and wipe the nozzle faces 72AM, 72AK, 72AC, and 72AY.).

The nozzle face wiping devices 160M, 160K, 160C, and 160Y are provided with moistening means (not shown) for moistening the wiping webs 192. The nozzle face wiping devices 160M, 160K, 160C, and 160Y moisten the wiping webs 192 as necessary to wipe the nozzle faces 72AM, 72AK, 72AC, and 72AY.

The nozzle face wiping devices 160M, 160K, 160C, and 160Y may also allow blades to come into contact with the nozzle faces 72AM, 72AK, 72AC, and 72AY to wipe the nozzle faces 72AM, 72AK, 72AC, and 72AY.

<Cap>

The caps 200M, 200K, 200C, and 200Y cover the tip portions of the heads 72M, 72K, 72C, and 72Y to seal up the nozzle faces 72AM, 72AK, 72AC, and 72AY.

The caps 200M, 200K, 200C, and 200Y are provided for the heads 72M, 72K, 72C, and 72Y, respectively. The caps 200M, 200K, 200C, and 200Y are installed so as to correspond to the nozzle faces 72AM, 72AK, 72AC, and 72AY of the heads 72M, 72K, 72C, and 72Y, respectively. That is, the caps are disposed along the longitudinal directions (the first direction) of the heads 72M, 72K, 72C, and 72Y, and are disposed so as to face the nozzle faces 72AM, 72AK, 72AC, and 72AY of the heads 72M, 72K, 72C, and 72Y, respectively, when the respective heads 72M, 72K, 72C, and 72Y are moved to the maintenance section 24. Particularly, since the nozzle faces 72AM, 72AK, 72AC, and 72AY of the heads 72M, 72K, 72C, and 72Y are installed in the ink jet recording device 10 of this embodiment on as to be inclined, the caps 200M, 200K, 200C, and 200Y are also installed so as to be inclined.

The structures of the caps 200M, 200K, 200C, and 200Y will be described in more detail below.

A waste liquid tray 154 is provided below the nozzle face wiping devices 160M, 160K, 160C, and 160Y and the caps 200M, 200K, 200C, and 200Y. The nozzle face wiping devices 160M, 160K, 160C, and 160Y and the caps 200M, 200K, 200C, and 200Y are installed inside the waste liquid tray 154. A waste liquid tank 158 is connected to the waste liquid tray 154 through a waste liquid recovery pipe 156. Moisturizing liquid, which is supplied to the caps 200M, 200K, 200C, and 200Y, or ink, which is pumped to the caps 200M, 200K, 200C, and 200Y, is discharged to the waste liquid tray 154 and is recovered by the waste liquid tank 158.

<<Details of Cap>>

As described above, the caps 200M, 200K, 200C, and 200Y cover the tip portions of the heads 72M, 72K, 72C, and 72Y to seal up the nozzle faces 72AM, 72AK, 72AC, and 72AY.

Meanwhile, since the respective caps 200M, 200K, 200C, and 200Y have the same structure, the caps 200M, 200K, 200C, and 200Y will be described below as the cap 200.

Figure 9:
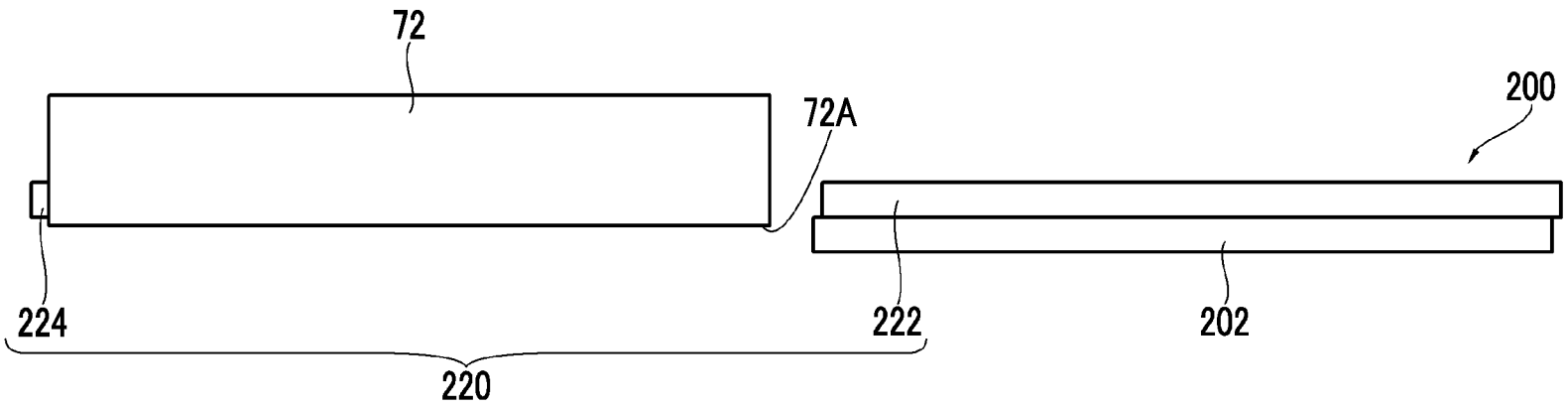
FIG. 9 is a side view showing the entire structure of a cap.
Figure 10:
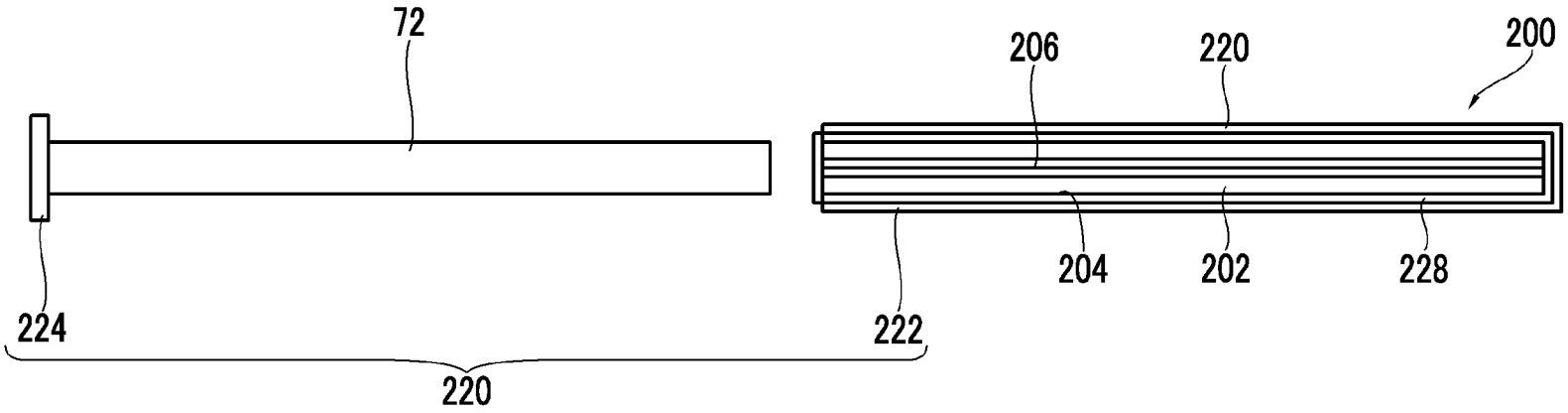
FIG. 10 is a plan view showing the entire structure of the cap.
Figure 11:
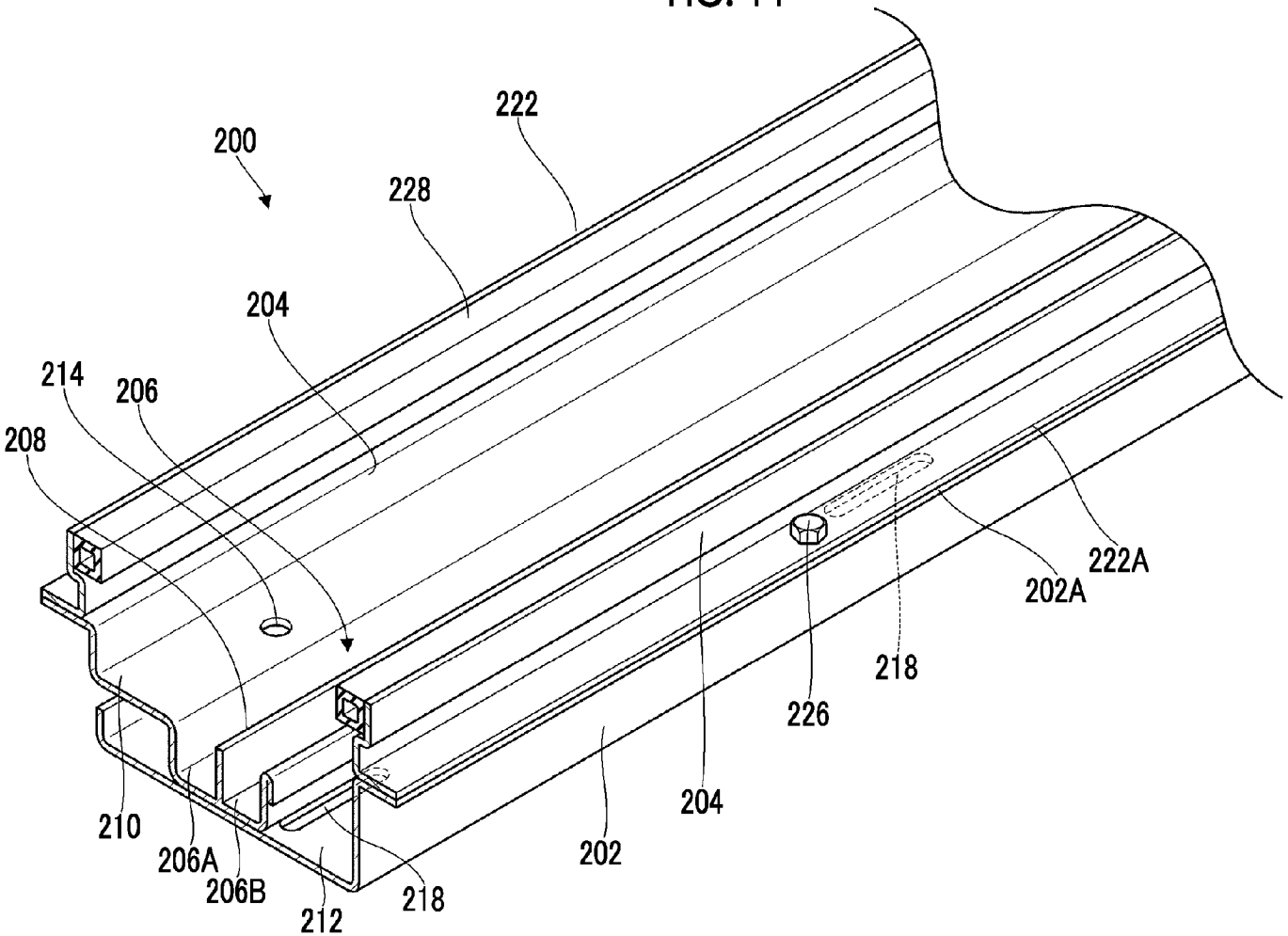
FIG. 11 is an enlarged perspective view of a part of the cap.

FIG. 9 is a side view showing the entire structure of the cap, and FIG. 10 is a plan view showing the entire structure of the cap. Further, FIG. 11 is an enlarged perspective view of a part of the cap.

The cap 200 mainly includes a cap body 202 and a sealing member 220 that is disposed along an opening portion 204 of the cap body 202.

The cap body 202 is formed of a box including an opening portion 204, and is adapted to be capable of receiving a tip portion of the head 72. Here, the cap body 202 is formed of a long box so as to correspond to the head 72 that is formed of a long line head.

A liquid retaining part 206, which stores moisturizing liquid, is provided in the cap body 202. The liquid retaining part 206 has the shape of a groove and is disposed along the longitudinal direction of the cap body 202.

A partition plate 208 is disposed in the liquid retaining part 206 along the longitudinal direction. An inner space of the liquid retaining part 206 is partitioned into two spaces, that is, a first storage portion 206A, which is positioned on the upper side in an inclination direction, and a second storage portion 206B, which is positioned on the lower side in the inclination direction, by the partition plate 208 (see FIG. 11).

An upper stage portion 210, which is positioned on the upper side in the inclination direction, and a lower stage portion 212, which is positioned on the lower side in the inclination direction, are provided on the bottom of the liquid retaining part 206 with the liquid retaining part 206 interposed therebetween. The upper stage portion 210 is formed of a surface that has substantially the same height as an upper edge portion of the liquid retaining part 206, and the lower stage portion 212 is formed of a surface that has substantially the same height as the bottom portion of the liquid retaining part 206.

The upper stage portion 210 is provided with a plurality of moisturizing liquid supply ports 214 that are arranged along the longitudinal direction of the cap body 202. A moisturizing liquid supply pipe 216 is connected to each of the moisturizing liquid supply ports 214 (see FIG. 14). The moisturizing liquid supply pipes 216 are connected to a moisturizing liquid supply device (not shown). When moisturizing liquid is supplied from the moisturizing liquid supply device, moisturizing liquid is supplied into the cap body 202 from the moisturizing liquid supply ports 214. The supplied moisturizing liquid flows on the upper stage portion 210 and is stored in the liquid retaining part 206.

The lower stage portion 212 is provided with a plurality of drain ports 218 that are arranged along the longitudinal direction of the cap body 202. Moisturizing liquid, which overflows from the liquid retaining part 206, or ink, which is pumped from the head 72, is recovered by the lower stage portion 212 and is discharged from the drain ports 218. Ink or the like, which is discharged from the drain ports 218, is recovered by the waste liquid tray 154.

The sealing member 22C) is formed of a frame having a quadrangular shape as a whole, and is disposed along the peripheral edge of the opening portion 204 of the cap body 202. The sealing member 220 is adapted to be capable of being divided into a first frame component 222 and a second frame component 224, and the first frame component 222 and the second frame component 224 are combined with each other to form the frame.

The first frame component 222 forms three sides of the frame including two sides parallel to the longitudinal direction (the first direction) of the cap body 202, and has a substantially U shape in plan view. The second frame component 224 forms the other side of the frame (one short side), and has a substantially I shape in plan view.

The first frame component 222 is provided integrally with the cap body 202, and the head 72 is provided with the second frame component 224. When the cap 200 is mounted on the head 72, the first frame component 222 and the second frame component 224 are integrated with each other and surround the outer periphery of a tip portion of the head 72.

A flange portion 222A is formed at a lower end portion of the first frame component 222. Meanwhile, a flange portion 202A is formed at the cap body 202 along the peripheral edge of the opening portion 204. When the flange portion 222A is fixed to the flange portion 202A of the cap body 202 by bolts 226, the first frame component 222 is integrally mounted on the cap body 202.

The first frame component 222, which is integrally mounted on the cap body 202, is a wall that vertically extends so as to surround the opening portion 204 of the cap body 202, and is integrated with the cap body 202.

An elastic member 228 as a seal is provided on the inner peripheral portion of the first frame component 222. When the head 72 is mounted, the elastic member 228 comes into close contact with the outer periphery of a tip portion of the head 72 and seals a gap formed between the head 72 and the first frame component 222. The elastic member 228 can be made of, for example, rubber, brush, felt, or the like. Particularly, a member, which is made of hollow silicon rubber coated with fluorine, is suitably used as the elastic member 228.

The second frame component 224 of the head 72 is mounted on one end of the head 72 in the longitudinal direction. The second frame component 224 has a shape corresponding to the short side of the first frame component 222.

<<Action of Cap>>

[Mounting of Head on Cap]

Figures 12A, 12B, 12C:
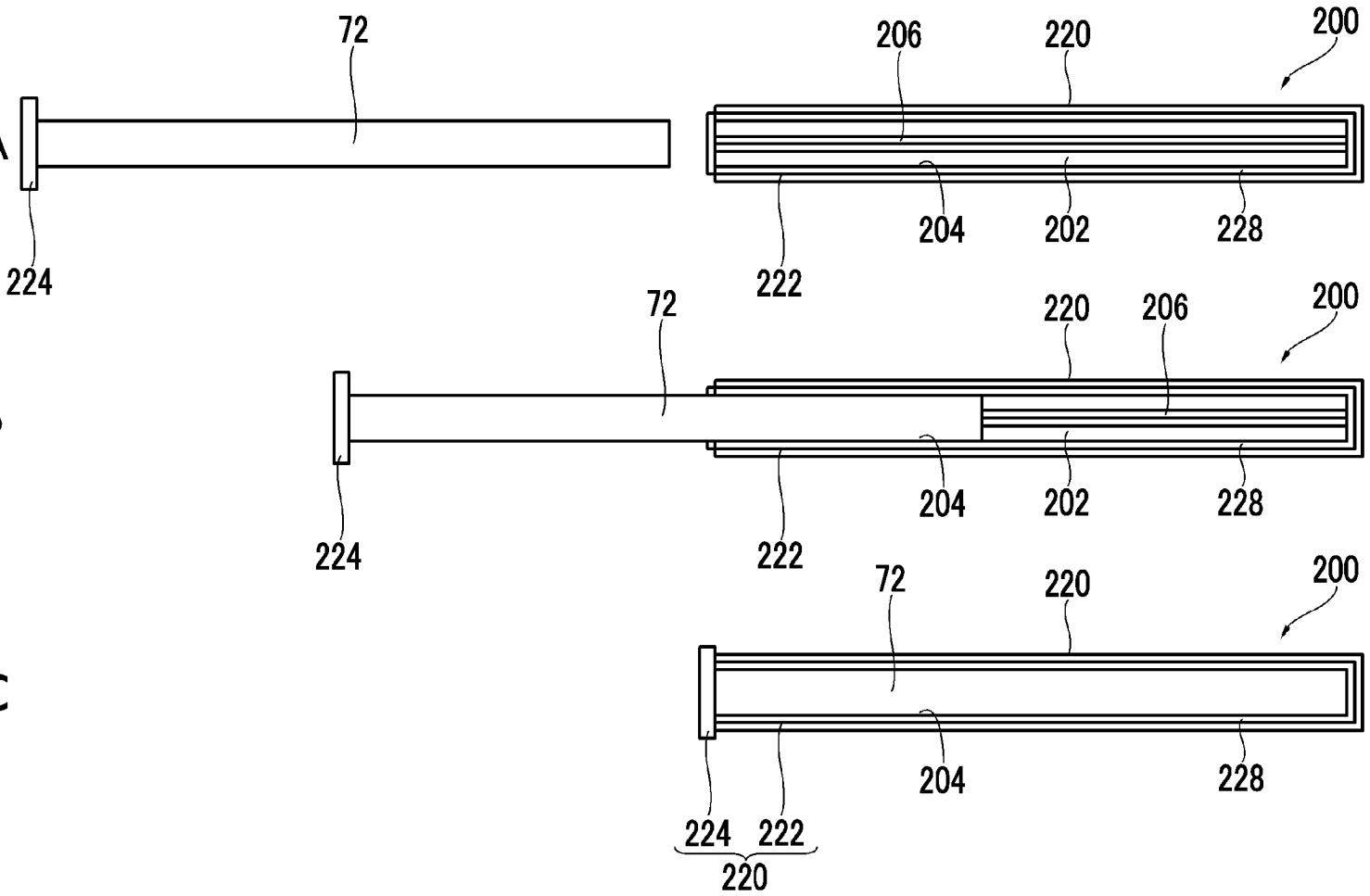
FIGS. 12A to 12C are side views showing a procedure for mounting the head on the cap.

FIGS. 12A to 12C are side views showing a procedure for mounting the head on the cap and FIGS. 13A to 13D are plan views showing a procedure for mounting the head on the cap.

The head 72 is moved to the maintenance section 24 in a case in which the cap 200 is to be mounted on the head 72. The movement of the head 72 during the mounting of the cap is controlled by the controller (not shown).

Figures 13A, 13B, 13C, 13D:
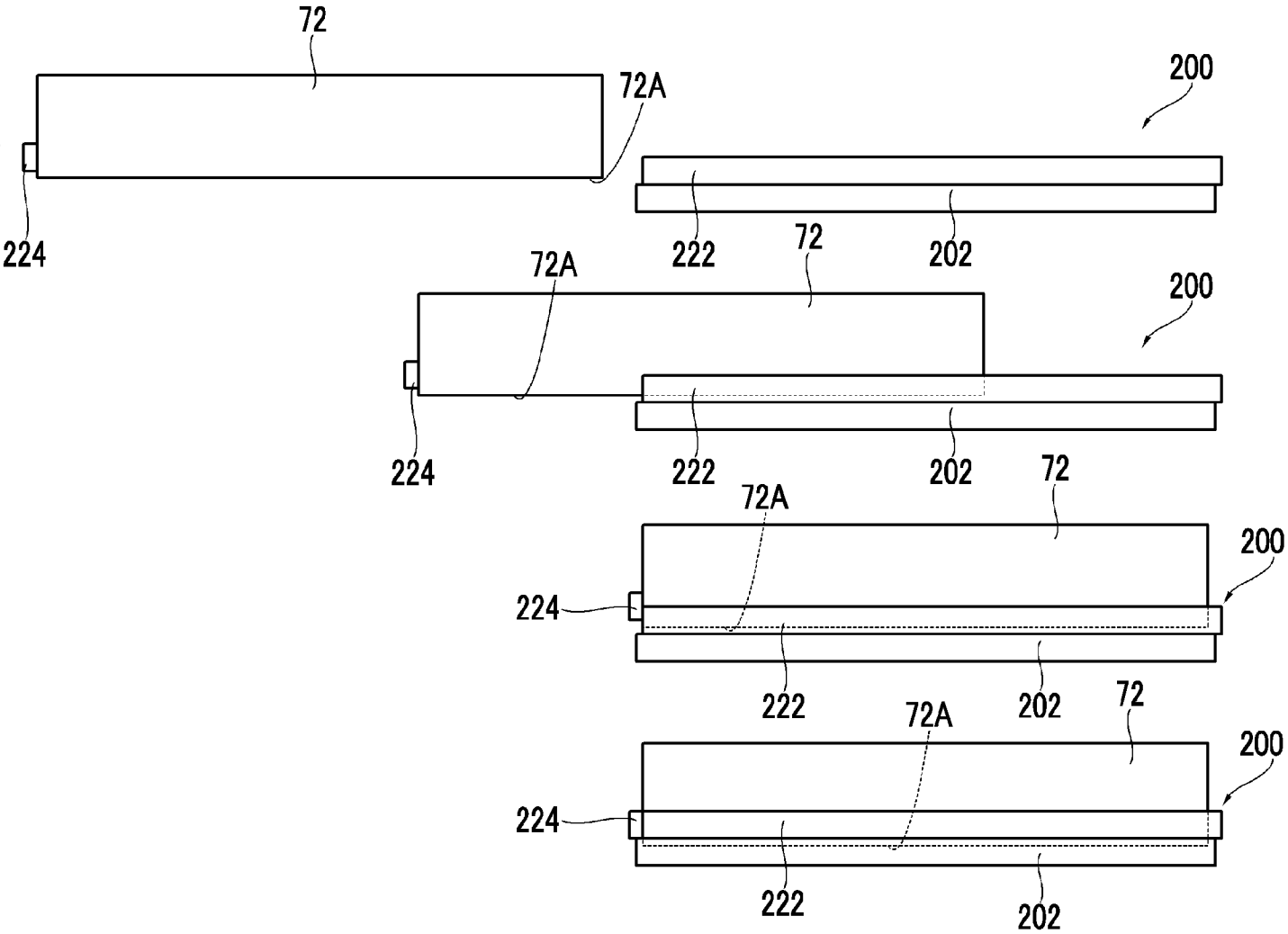
FIGS. 13A to 13D are plan views showing a procedure for mounting the head on the cap.

First, the head 72 disposed above the drawing drum 70 is moved in a direction orthogonal to the nozzle face 72A and is moved (retracted) to a retracted position that is retracted from the peripheral surface of the drawing drum 70 by a predetermined height. FIG. 12A and FIG. 13A show a state in which the head 72 is positioned at the retracted position.

After that, the head 72 is horizontally transferred toward the maintenance section 24 (the head 72 is transferred along the nozzle face 72A in the longitudinal direction (the first direction)).

As shown in FIGS. 12B and 13B, a tip portion of the head 72, which is horizontally transferred toward the maintenance section 24, in a movement direction is fitted to the first frame component 222 of the sealing member 220 of the cap 200.

When the head 72 is transferred to a position directly above the cap 200 (mounting position), the head 72 stops. When the head 72 is transferred to the mounting position as shown in FIGS. 12C and 13C, the second frame component 224 of the head 72 is joined to the first frame component 222 and a tip portion of the head 72 is surrounded by the sealing member 220 that includes the first frame component 222 and the second frame component 224. Further, the head 72 is disposed at this position so that the nozzle face 72A of the head 72 faces the opening portion 204 of the cap body 202.

After that, the head 72 is moved toward the cap body 202 in the direction (the second direction), which is orthogonal to the nozzle face 72A, a predetermined distance, and is mounted on the cap 200 (FIG. 13D).

According to the cap 200 of this embodiment, since the sealing member 220 is adapted to be divided as described above, the cap 200 can be simply mounted on the head 72 as compared to a cap that is adapted to be directly fitted to the opening portion.

Further, since an outer peripheral portion of a tip portion of the head 72 is surrounded by the sealing member 220 and the nozzle face 72A is sealed up, other members do not come into contact with the nozzle face 72A and the nozzle face 72A can be sealed up without being contaminated.

[Moisturization]

Figure 14:
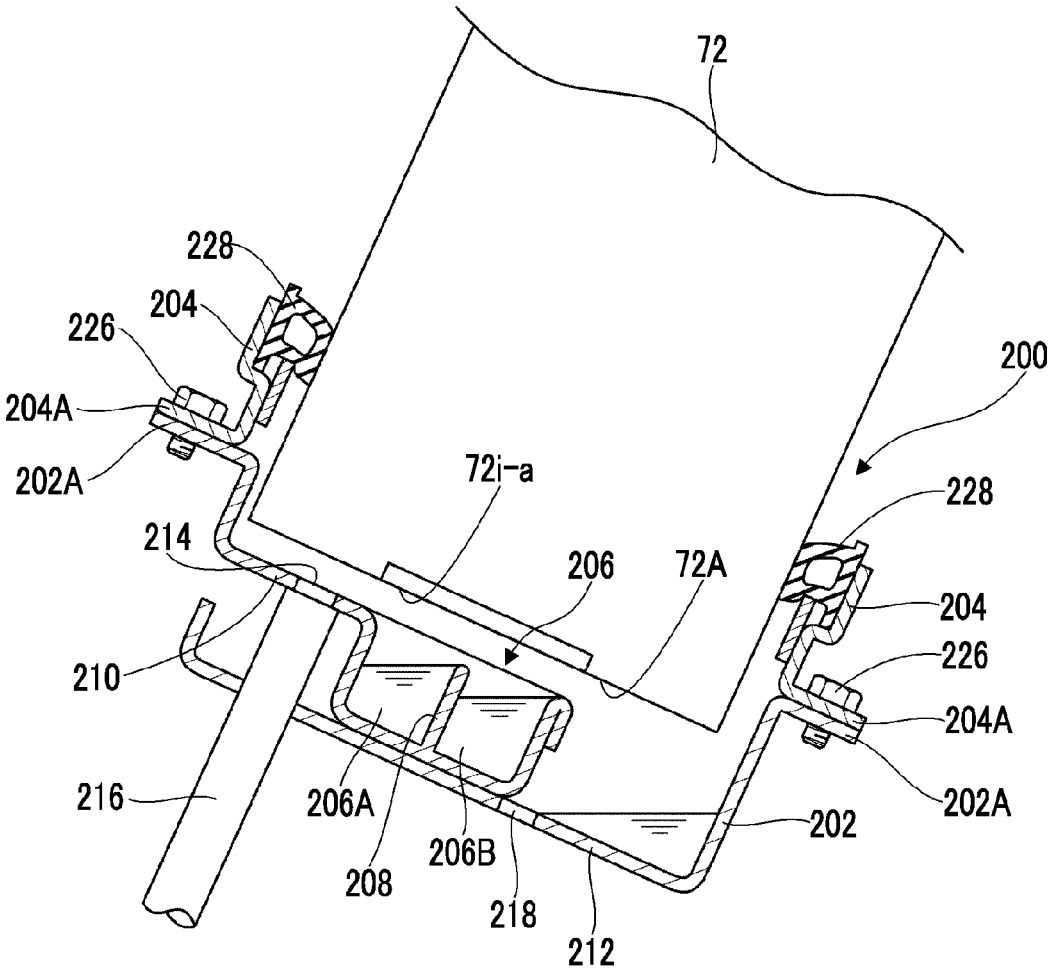
FIG. 14 is a cross-sectional view showing a state at the time of capping.

FIG. 14 is a cross-sectional view showing a state at the time of capping.

When the cap 200 is mounted on the head 72 as shown in FIG. 14, a tip portion of the head 72 is received in the cap body 202. The head 72 is disposed in this state on that the nozzle arrangement portion 72-*ia*, of the nozzle face 72A is close to the liquid retaining part 206. Further, the elastic member 228 comes into contact with the outer periphery of a tip portion of the head 72 and a gap is sealed.

[Purging]

Figure 15:
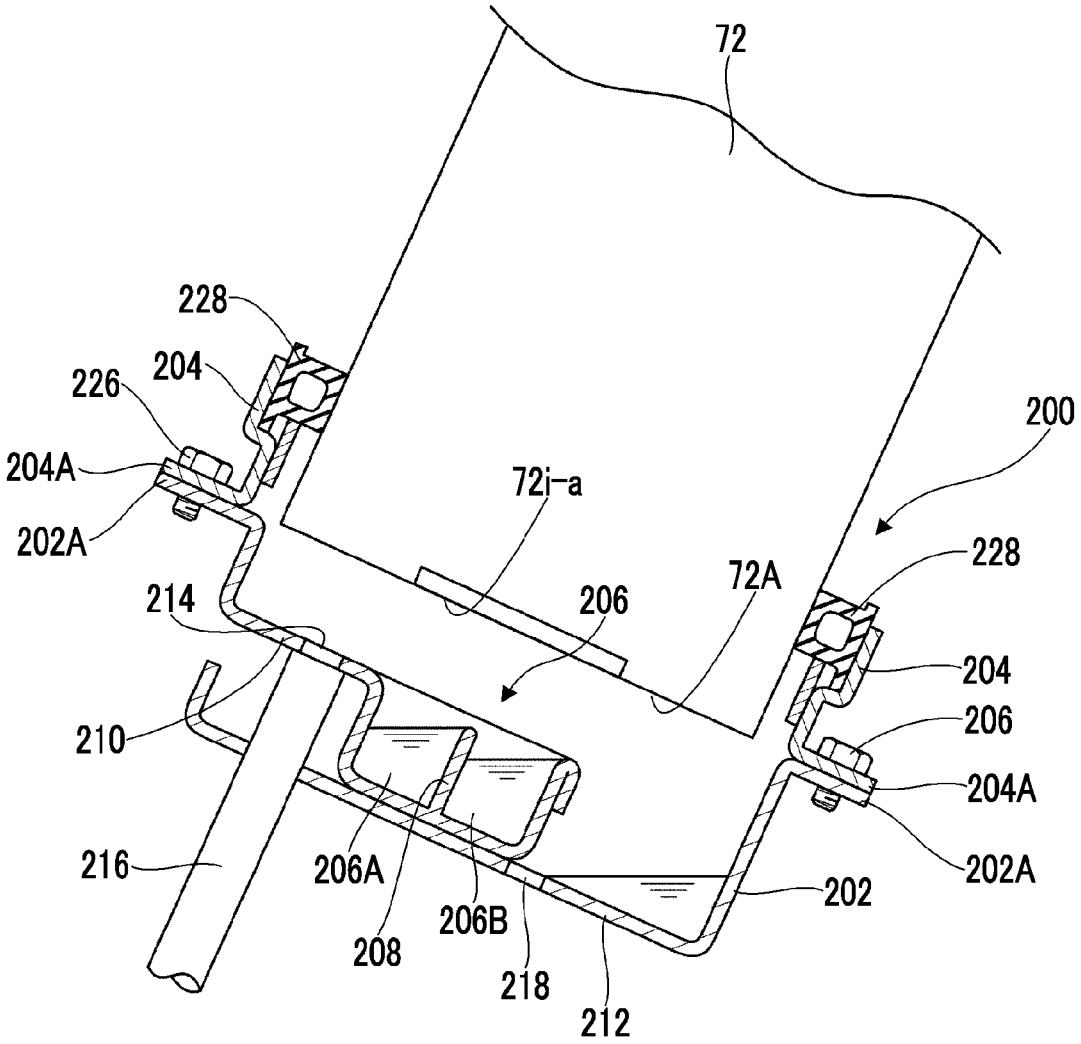
FIG. 15 is a cross-sectional view showing a state at the time of purging.

FIG. 15 is a cross-sectional view showing a state at the time of purging.

Purging is performed in the cap 200 as described above.

The head 72 is moved to a purging position in a case in which purging is performed. That is, the head 72 is moved in the direction, which is orthogonal to the nozzle face, (moved up) by a predetermined distance, and the nozzle face 72A of the head 72 is separated from the liquid retaining part 206. Accordingly, it is possible to prevent purged ink from coming into contact with the liquid retaining part 206. Purged ink is recovered by the lower stage portion 212, and is recovered from the drain ports 218.

Meanwhile, even at this purging position, the head 72 is in a state in which the outer periphery of a tip portion of the head 72 is surrounded by the sealing member 220. Accordingly, it is possible to prevent purged ink from overflowing to the periphery.

[Detachment of Cap]

An operation reverse to an operation during the mounting of the cap is performed in a case in which the cap 200 is to be detached. That is, the head 72 is moved up in a direction in which the head 72 is separated from the cap 200, and is then moved horizontally to the drawing section 16.

In more detail, the head 72 is moved in the direction (second direction), which is orthogonal to the nozzle face 72A, by a predetermined distance and is moved to a separation position. Then, the head 72 is horizontally moved along the longitudinal direction (the first direction) and is moved to the drawing section 16.

Here, the separation position is set to a position where the head 72 can be separated from the cap 200 by being moved horizontally (a position where the nozzle face 72A is present above the opening portion of the cap body 202), and is set to a position where a tip portion of the head 72 is covered with the sealing member 220. In more detail, the separation position is set to a position where the nozzle face 72A is positioned below the elastic member 228.

Accordingly, the head 72 can be moved toward the drawing section 16 in a state in which a tip portion of the head 72 is sealed up by the sealing member 220. Therefore, ink, which drips from the head 72 during the movement of the head 72, can be caught by the cap 200.

Meanwhile, the separation position can be set to a position of which the height is the same as the height of the mounting position. Further, the purging position and the separation position can also be set to positions having the same height. When the purging position and the separation position are set to positions having the same height, it is possible to transfer the head 72 toward the drawing section 16 just as it is after purging.

Furthermore, it is preferable that the separation position is set to a position having the same height as a position where wiping is performed by the nozzle face wiping devices 160M, 160K, 160C, and 160Y. That is, it is preferable that the nozzle face 72A is wiped by the nozzle face wiping devices 160M, 160K, 160C, and 160Y just as it is when the head 72 is horizontally moved in a state in which the head 72 is present at the separation position (the height of the wiping member is adjusted so that the wiping member (the wiping web) comes into contact with the nozzle face 72A of the head 72 horizontally moved from the separation position). Accordingly, since the nozzle face 72A can be wiped immediately after the head is removed from the cap 200, it is possible to prevent the surrounding environment from being contaminated by ink or the like that drips from the head 72.

Modification Example

Structure of Joint Portion

Figure 16:
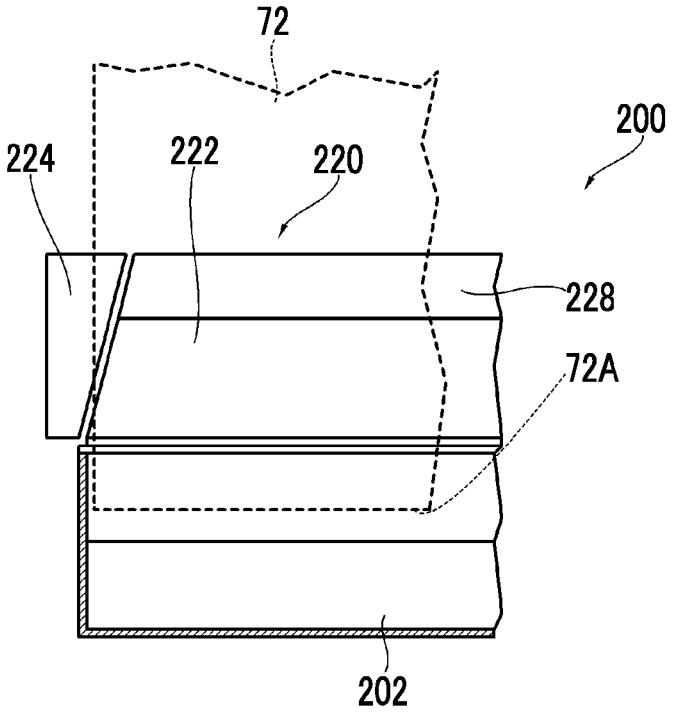
FIG. 16 is an enlarged cross-sectional view of main portions of a modification example of the cap.

FIG. 16 is an enlarged cross-sectional view of main portions of a modification example of the cap.

Joint portions (butting portions) of the first frame component 222 and the second frame component 224 of the sealing member 220 of the cap 200 are formed in a tapered shape.

Since the joint portions of the first frame component 222 and the second frame component 224 are formed in a tapered shape as described above, the head can be adapted to have a structure in which air does not easily enter the head from the joint portions. Accordingly, airtightness can be further improved.

Meanwhile, in this case, it is preferable that the sealing member 220 is adapted so that the first frame component 222 and the second frame component 224 do not completely come into close contact with each other during capping. That is, it is preferable that the joint portions are joined to each other with a constant gap therebetween when the first frame component 222 and the second frame component 224 are combined with each other. Accordingly, the first frame component 222 and the second frame component 224 come into contact with each other during capping, and damage to the head 72, which is caused by a shock generated from the contact between the first frame component 222 and the second frame component 224, or the like can be prevented.

Figure 17:
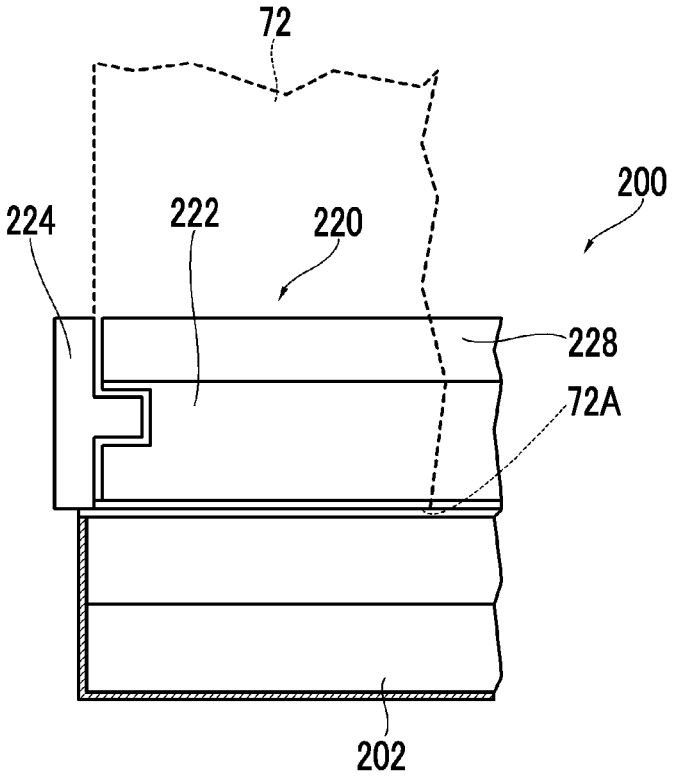
FIG. 17 is an enlarged cross-sectional view of main portions of the modification example of the cap.

The joint portions of the first frame component 222 and the second frame component 224 of the sealing member 220 can also have a labyrinth structure as shown in FIG. 17 other than the above-mentioned structure. Even in this case, airtightness can be ensured while the joint portions do not come into contact with each other.

[Aspect of Division of Sealing Member]

In the above-mentioned embodiment, the sealing member 220 has been divided into the first frame component 222 that forms three sides of the frame and the second frame component 224 that forms the other side of the frame. However, the aspect of the division of the sealing member 220 is not limited thereto. For example, the first frame component and the second frame component can also be formed in an L shape.

[Structure of Moving Device]

In the above-mentioned structure, the cap has been fixed and the head has been moved so that the cap is mounted on the head. However, the cap may be adapted to be moved. Further, both the cap and the head may be adapted to be moved. That is, as long as the head and the cap can be moved relative to each other, any structure can be applied.

Meanwhile, when the cap is fixed at a constant position as in the above-mentioned embodiment, a mechanism for moving the cap is not necessary. Accordingly, a structure can be simplified.

OTHER EMBODIMENTS

An example in which the invention is applied to a single-pass type ink jet recording device using line heads has been described in the above-mentioned embodiment. However, a range to which the invention is applied is not limited thereto, and the invention can also be applied to an ink jet recording device that records an image by plural numbers of times of scanning using a head while moving a short recording head, such as a serial type (shuffle scanning type) head.

Further, the invention can also be applied to a liquid droplet discharge device of which the nozzle face of a head is disposed horizontally.

Furthermore, an example in which the invention is applied to an ink jet recording device for printing a color image has been described in the above-mentioned embodiment, but a range to which the invention is applied is not limited to this example. For example, the invention can be widely applied to liquid droplet discharge devices (including an ink jet recording device and an ink jet system), which obtain various shapes or patterns by using a liquid functional material, such as a wiring drawing device for drawing a wiring pattern of an electronic circuit, an apparatus for manufacturing various devices, a resist printing device using resin liquid as functional liquid to be discharged, a device for manufacturing a color filter, and a microstructure forming device for forming a microstructure by using a material for material deposition.

Components of the above-mentioned embodiments of the invention can be appropriately modified and components can be added or removed from the above-mentioned embodiments within a range that does not depart from the scope of the invention. The invention is not limited to the above-mentioned embodiments, and can have many modifications within a technical scope of the invention through common knowledge in this field.

EXPLANATION OF REFERENCES

10: ink jet recording device
12: sheet feed section
14: treatment liquid applying section
16: drawing section
18: drying section
20: fixing section
22: sheet discharge section
24: maintenance section
26: intermediate transport section
28: intermediate transport section
30: intermediate transport section
50: sheet teed tray
52: sheet feed cylinder
54: treatment liquid drum
55: gripper
56: treatment liquid applying device
70: drawing drum
71: gripper
72 (72M, 72K, 72C, 72Y): head (ink jet head)
72A: nozzle face
72-*i*: head module
72-iA: nozzle face of head module
72-*ia*: nozzle arrangement portion
72-D: dummy plate
74: sheet pressing roller
76: drying drum
77: gripper
78: solvent drying device
80: heater
82: hot air nozzle
84: fixing drum
85: gripper
86: heater
88: fixing roller
90: in-line sensor
92: sheet discharge tray
94: chain conveyor
130: head moving mechanism
140: head support frame
142: frame transfer device
144: head support
146: guide rail
147: slider
148: feed device

148A: screw rod
148B: nut member
148C: motor
154: waste liquid tray
156: waste liquid recovery pipe
158: waste liquid tank
160 (160M, 160K, 160C, 160Y): nozzle face wiping device
192: wiping web
194: pressing roller
200 (200M, 200K, 200C, 200Y): cap
202: cap body
202A: flange portion of cap body
204: opening portion of cap body
206: liquid retaining part
206A: first storage portion
206B: second storage portion
208: partition plate
210: upper stage portion
212: lower stage portion
214: moisturizing liquid supply port
216: moisturizing liquid supply pipe
218: drain port
220: sealing member
222: first frame component
222A: flange portion of first frame component
224: second frame component
226: bolt
228: elastic member
310: support frame
312: cable
350: nozzle
P: sheet

What is claimed is:

1. A liquid droplet discharge device comprising:

a liquid droplet discharge head that includes a nozzle face at a tip thereof and discharges liquid droplets from nozzles provided on the nozzle face;

a cap that covers the nozzle face of the liquid droplet discharge head; and a moving device configured to relatively move the liquid droplet discharge head and the cap to mount the cap on the liquid droplet discharge head, wherein the cap includes a cap body that is formed of a box including an opening portion and is disposed so that the opening portion faces the nozzle face, and a sealing member that is formed of a frame capable of being divided in a direction along the nozzle face into a first frame component and a second frame component, is disposed along a peripheral edge of the opening portion of the cap body, and surrounds an outer periphery of an end portion of the liquid droplet discharge head, wherein the cap body is provided with the first frame component the liquid droplet discharge head is provided with the second frame component, and the cap and the liquid droplet discharge head are integrated with each other and form a frame when the cap is mounted on the liquid droplet discharge head.

2. The liquid droplet discharge device according to claim 1, wherein the sealing member includes an elastic member that is provided on an inner peripheral portion of the first frame component.

3. The liquid droplet discharge device according to claim 1, wherein the cap body of the cap is fixed at a predetermined position, and the moving device is configured to move the liquid droplet discharge head to mount the cap on the liquid droplet discharge head.

4. The liquid droplet discharge device according to claim 1, wherein joint portions of the first and second frame components have a tapered shape and are joined to each other with a constant gap therebetween.

5. The liquid droplet discharge device according to claim 1, wherein joint portions of the first and second frame components have a labyrinth structure and are joined to each other with a constant gap therebetween.

6. The liquid droplet discharge device according to claim 1, wherein the moving device is adapted to be capable of moving the liquid droplet discharge head in a first direction along the nozzle face and a second direction orthogonal to the nozzle face, the liquid droplet discharge device further comprises a controller that controls the moving device, and the controller moves the liquid droplet discharge head to a mounting position in the first direction and then moves the liquid droplet discharge head toward the cap body in the second direction to mount the cap on the liquid droplet discharge head in a case in which the cap is to be mounted on the liquid droplet discharge head, and moves the liquid droplet discharge head to a separation position in the second direction and then moves the liquid droplet discharge head in the first direction to separate the cap from the liquid droplet discharge head in a case in which the cap is to be separated from the liquid droplet discharge head.

7. The liquid droplet discharge device according to claim 6, wherein the outer periphery of the tip portion of the liquid droplet discharge head has a quadrangular shape, and the sealing member is formed of a quadrangular frame, and is adapted to be capable of being divided into the first frame component, which forms three sides of the frame including two sides parallel to the first direction, and the second frame component that forms the other side of the frame.

8. The liquid droplet discharge device according to claim 7, wherein the first frame component has a height that allows the first frame component to surround the outer periphery of the tip portion of the liquid droplet discharge head when the liquid droplet discharge head is positioned at the separation position.

9. The liquid droplet discharge device according to claim 8, further comprising:

a wiping member that is installed on a movement path of the liquid droplet discharge head moved in the first direction and comes into contact with the nozzle face of the liquid droplet discharge head moved from the separation position in the first direction to wipe the nozzle face.

10. The liquid droplet discharge device according to claim 6, wherein the liquid droplet discharge head is installed to be rotated about an axis parallel to the first direction so that the nozzle face is inclined with respect to a horizontal plane.

11. The liquid droplet discharge device according to claim 10, wherein the liquid droplet discharge head is formed of a long line head in which nozzles are arranged along the first direction.

12. The liquid droplet discharge device according to claim 1, wherein the cap body includes a liquid retaining part in which moisturizing liquid is stored.

* * * * *